US007789801B2

(12) United States Patent
Stearns et al.

(10) Patent No.: US 7,789,801 B2
(45) Date of Patent: Sep. 7, 2010

(54) TOTAL BODY EXERCISE METHODS AND APPARATUS

(76) Inventors: Kenneth W Stearns, P.O. Box 55912, Houston, TX (US) 77255; Joseph D Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 12/482,216

(22) Filed: Jun. 10, 2009

(65) Prior Publication Data

US 2009/0291804 A1 Nov. 26, 2009

Related U.S. Application Data

(60) Division of application No. 10/712,784, filed on Nov. 12, 2003, now Pat. No. 7,556,589, which is a continuation-in-part of application No. 09/684,667, filed on Oct. 6, 2000, now Pat. No. 6,672,994.

(51) Int. Cl.
*A63B 71/00* (2006.01)

(52) U.S. Cl. ..... 482/8; 482/1; 482/9; 482/51; 482/901; 434/247

(58) Field of Classification Search ..... 482/1–9, 482/51–78, 900–902; 434/247
See application file for complete search history.

(56) References Cited

U.S. PATENT DOCUMENTS 3,869,121 A * 3/1975 Flavell ..... 482/2
4,714,244 A * 12/1987 Kolomayets et al. ..... 482/72
4,776,583 A * 10/1988 Jennings ..... 482/63
4,785,674 A 11/1988 Orman et al.
4,934,694 A * 6/1990 McIntosh ..... 482/9
5,125,648 A 6/1992 Olschansky et al.
5,129,872 A 7/1992 Dalton et al.
5,135,447 A * 8/1992 Robards et al. ..... 482/52
5,149,084 A * 9/1992 Dalebout et al. ..... 482/3
5,181,894 A 1/1993 Shieng
5,591,104 A * 1/1997 Andrus et al. ..... 482/7
5,919,115 A 7/1999 Horowitz et al.
5,989,157 A * 11/1999 Walton ..... 482/4
6,080,088 A * 6/2000 Petersen et al. ..... 482/72
6,277,055 B1 8/2001 Birrell et al.

* cited by examiner

*Primary Examiner*—Glenn Richman
(74) *Attorney, Agent, or Firm*—Chernoff, Vilhauer, McClung & Stenzel

(57) ABSTRACT

An exercise apparatus includes a frame, an arm supporting member, and a leg supporting member. A sensor is connected to at least one of the arm supporting member and the leg supporting member, and/or a resilient member is interconnected between the arm supporting member and either the leg supporting member or the frame. The sensor communicates with a user display and/or a resistance device to indicate the amounts of work performed by the arm supporting member and the leg supporting member, and/or to adjust resistance to movement of the leg supporting member as a function of user force applied against the arm supporting member. The resilient member encourages synchronization of the arm supporting member and the leg supporting member, while allowing some relative movement therebetween. A user interface displays data associated with exercise activity, including relative amounts of work performed by a user's arms and legs and/or performed during different phases of exercise, including discrete aerobic and anaerobic phases. The interface display and the level of resistance are preferably changed as part of the transition between phases.

13 Claims, 16 Drawing Sheets

Fig. 5
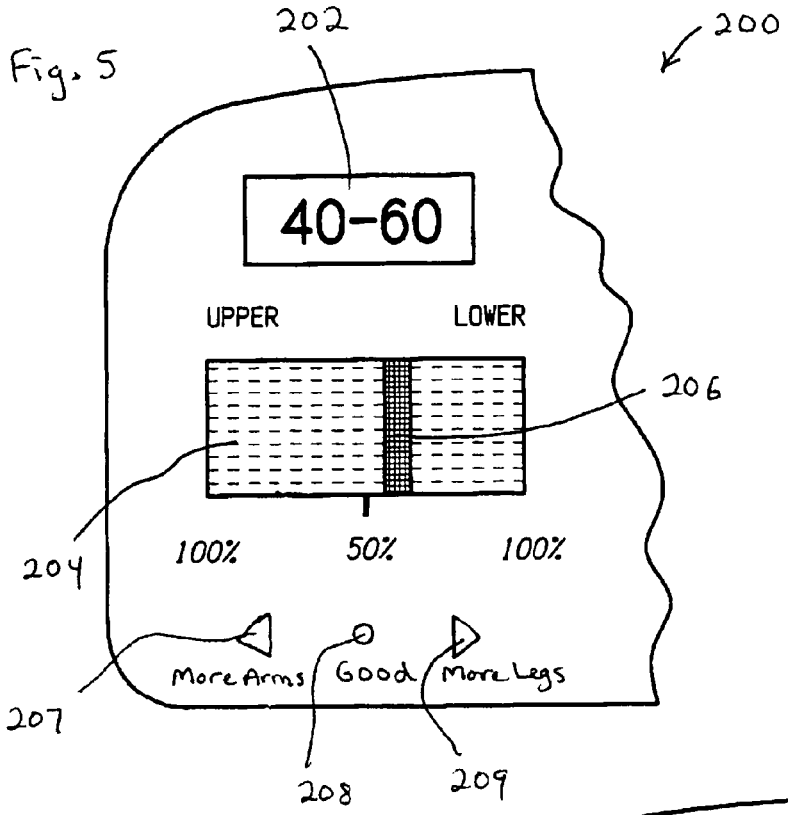
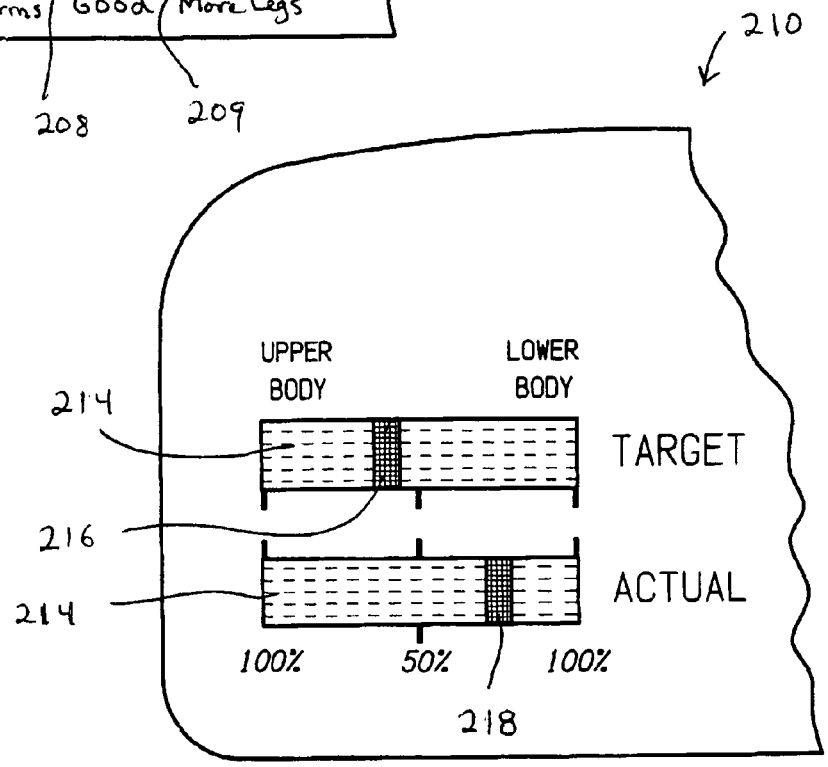
Fig. 6

TOTAL BODY EXERCISE METHODS AND APPARATUS

CROSS-REFERENCE TO RELATED APPLICATION

This is a continuation-in-part of U.S. patent application Ser. No. 09/684,667, filed on Oct. 6, 2000.

FIELD OF THE INVENTION

The present invention relates to exercise methods and apparatus, including relationships between arm supporting members and leg supporting members on various types of exercise equipment, and/or switching between different phases of exercise performed on exercise equipment.

BACKGROUND OF THE INVENTION

Exercise equipment has been designed to facilitate various exercise motions, many of which incorporate both arm movements and leg movements. Examples of such equipment include elliptical exercise machines (U.S. Pat. Nos. 5,242,343, 5,423,729, 5,540,637, 5,725,457, and 5,792,026); free form exercise machines (U.S. Pat. Nos. 5,290,211 and 5,401,226); rider exercise machines (U.S. Pat. Nos. 2,603,486, 5,695,434, and 5,997,446); glider/strider exercise machines (U.S. Pat. Nos. 4,940,233 and 5,795,268); stepper exercise machines (U.S. Pat. No. 4,934,690); bicycle exercise machines (U.S. Pat. Nos. 4,188,030 and 4,509,742); recumbent cycling machines (U.S. Pat. No. 5,938,570); and other miscellaneous exercise machines (U.S. Pat. Nos. 4,869,494 and 5,039,088). These patents are incorporated herein by reference as examples of suitable applications for the present invention.

Generally speaking, the foregoing exercise machines have arm supporting members and leg supporting members which are typically synchronized to facilitate a coordinated "total body" exercise motion. The synchronized motion is considered advantageous to the extent that it makes the equipment relatively easy to use. On the other hand, the perceived quality of exercise tends to exceed the actual quality of exercise because the arms typically perform very little work. In other words, the arms may be described generally as "along for the ride."

In contrast to the foregoing machines, other exercise machines have been developed to provide independent upper body exercise and lower body exercise. One notable example is the NordicTrack ski machine (U.S. Pat. No. 4,728,102). On machines of this type, both the perceived quality of exercise and the actual quality of exercise are relatively greater. The trade-off is that many people consider such machines difficult to use, due to the independent nature of the arm motions and the leg motions. Recognizing that each of the foregoing types of total body exercise machines suffers certain shortcomings, room for improvement remains with respect to total body exercise machines.

All of the foregoing exercise machines are used primarily for purposes of aerobic exercise. Various other sorts of equipment are provided to facilitate anaerobic or strength exercise. In other words, a need also exists for exercise equipment that facilitates both aerobic and anaerobic exercise, and/or encourages users to switch between these two types of exercise.

SUMMARY OF THE INVENTION

The present invention provides unique methods and apparatus for facilitating total body exercise, displaying data associated with total body exercise, and/or switching between aerobic and anaerobic exercise.

In one sense, the present invention may be described as encouraging one or more arm supporting members to be synchronized relative to respective leg supporting member(s) while allowing relative movement between the arm supporting members and respective leg supporting members in response to the application of force by a user. The present invention may also be said to encourage one or more arm supporting members to be synchronized relative to respective leg supporting member(s) while subjecting the arm supporting members to resistance which is applied and/or measured independent of the leg supporting members. The present invention may also be said to encourage a person to switch between two different modes of exercise involving arm supporting members and/or leg supporting members.

Various aspects of the present invention may be described with reference to an exercise machine having a frame, left and right leg supporting members, and left and right arm supporting members. Each leg supporting member is part of a linkage assembly designed to accommodate foot motion through a generally elliptical path, and each arm supporting member is pivotally connected to the frame and/or a respective leg supporting member to accommodate hand motion through a generally reciprocal path. A separate resilient member may be interconnected between each arm supporting member and either the frame or a respective leg supporting member to bias the arm supporting member to move through a particular path in response to movement the respective leg supporting member. In such cases, each arm supporting member remains synchronized with a respective leg supporting member in the absence of user force applied against the arm supporting member.

This same exercise machine preferably includes a resistance device to provide adjustable resistance to movement of the leg supporting members and the arm supporting members, and sensors for detecting user force exerted against respective arm supporting members. In one desired mode of operation, resistance to movement of the leg supporting members is set, and the resistance is subsequently adjusted in response to measurements of user force applied against the arm supporting members. As a result, upper body work can increase or decrease without affecting the amount of lower body work being performed by the user.

Alternative embodiments of the present invention may be implemented with this "responsive resistance" arrangement to the exclusion of the resilient members discussed in the preceding paragraph, or with the resilient members to the exclusion of the "responsive resistance" arrangement. Different embodiments of the present invention may also be implemented with different numbers and types of leg supporting members and/or arm supporting members.

The present invention may also be described in terms of distinguishing between work performed by a user's arms and work performed by a user's legs. For example, a controller may periodically sense the force exerted by a user's arms and display the amount of upper body work being performed, either alone or in comparison to lower body work and/or target levels of work. The amount of lower body work may be determined by calculating the total amount of work (based on the resistance setting and speed of exercise) and subtracting the amount of upper body work (based on forces measured at the arm supporting members). The same controller may also adjust the leg resistance device based upon the work being performed by the user's arms (as discussed above) and/or the total work being performed (for example).

The present invention may also be described in terms of distinguishing between one or more modes of aerobic or cardio exercise, and one or more modes of anaerobic or strength exercise. For example, a controller may periodically switch between modes of exercise and display data associated with the current mode. The switch in modes may involve a change in resistance to encourage a different type of exercise (e.g. relatively less resistance in the cardio mode, and relatively greater resistance in the strength mode), or a change in the amount or percentage of force exerted by a person's upper body (e.g. less arm work in the cardio mode, and relatively greater arm work in the strength mode).

Certain embodiments and applications of the present invention are described in greater detail below and/or shown in the accompanying figures. However, the present invention is not limited to these particular embodiments and/or applications, nor even to the types of machines on which they are shown. Moreover, the present invention is applicable to different combinations of force receiving and/or limb moving members, and may be implemented in different ways on different machines. Additional variations and/or advantages will become more apparent from the detailed description that follows.

BRIEF DESCRIPTION OF THE DRAWING

With reference to the Figures of the Drawing, wherein like numerals represent like parts and assemblies throughout the several views.

FIG. 5 is a plan view of an alternative user interface display;

FIG. 6 is a plan view of another alternative user interface display;

DETAILED DESCRIPTION OF PREFERRED EMBODIMENTS

Figure 1:
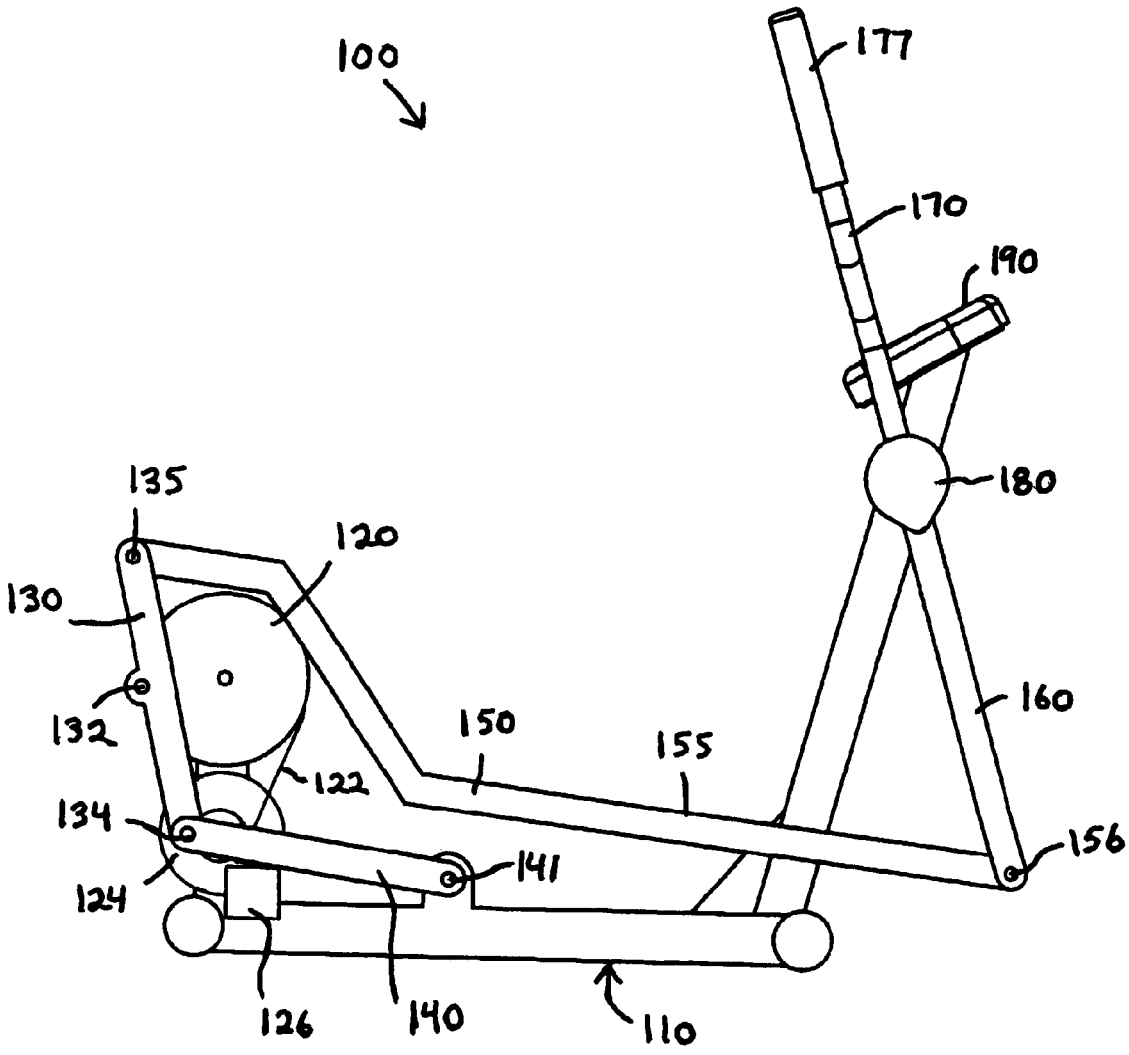
FIG. 1 is a side view of an exercise apparatus constructed according to the principles of the present invention.
Figure 2:
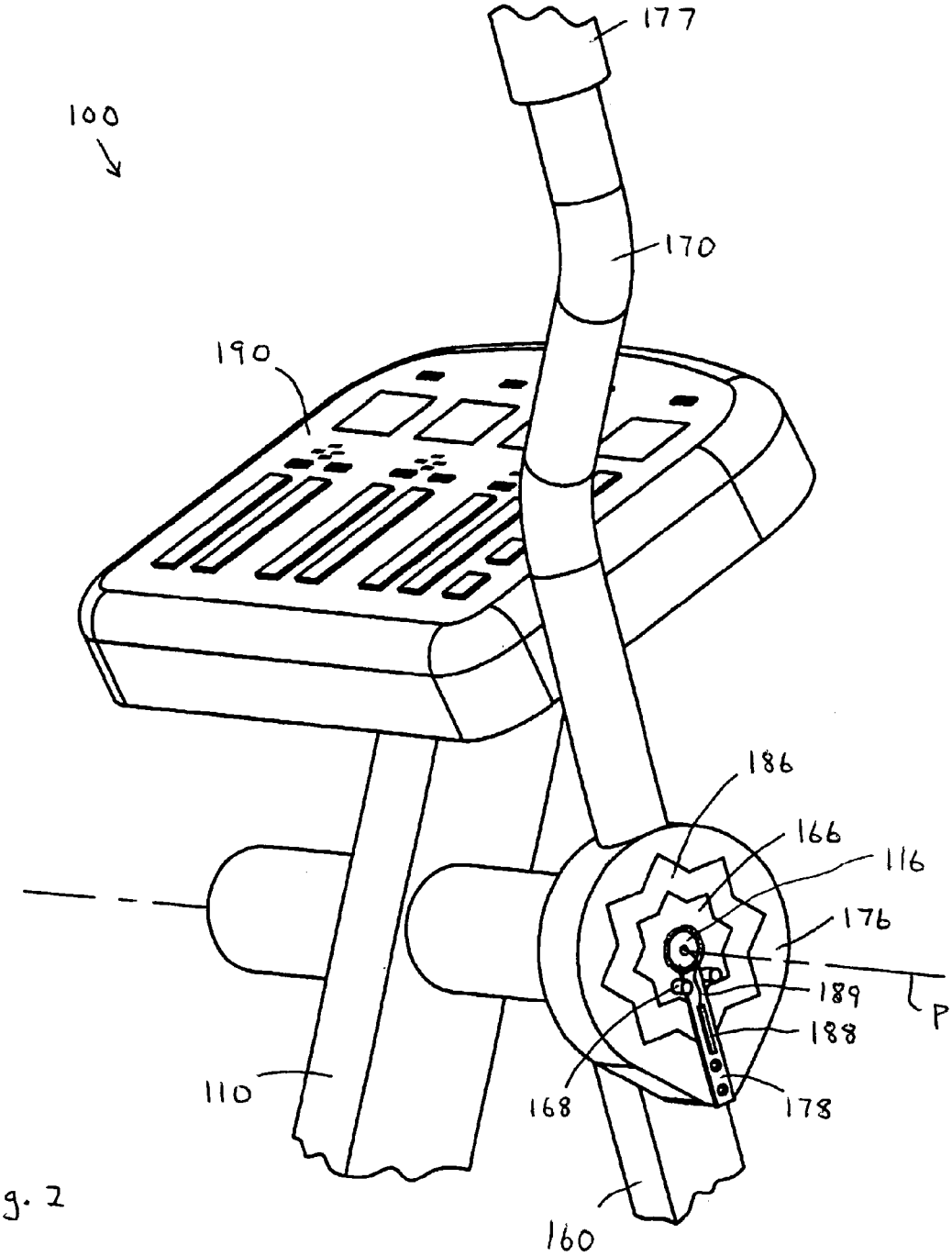
FIG. 2 is an enlarged perspective view of a portion of the exercise apparatus of FIG. 1.

An exercise apparatus constructed according to the principles of the present invention is designated as 100 in FIGS. 1-2. The exercise apparatus 100 is an elliptical motion exercise machine that is similar in many respects to certain exercise machines disclosed in U.S. Pat. No. 5,895,339 (which is incorporated herein by reference). However, the various aspects of the present invention are not limited to this specific type of exercise machine nor to any particular category of exercise machines, but rather, are suitable for use on various sorts of exercise equipment. Examples of some other suitable applications for the present invention are disclosed in the prior art patents identified above in the Background of the Invention.

The exercise apparatus 100 is generally symmetrical about a vertical plane extending lengthwise through its center. Generally speaking, the apparatus 100 includes similar "right-hand" linkage components and "left-hand" linkage components which are disposed on opposite sides of the plane of symmetry, and which are one hundred and eighty degrees out of phase relative to one another. Like reference numerals are used to designate both the "right-hand" and "left-hand" parts, and when reference is made to one or more parts on one side of an apparatus, it is to be understood that corresponding part(s) are disposed on the opposite side of the apparatus. Certain components, which are intersected by the plane of symmetry and/or are associated with the inertial characteristics of the linkage assembly, exist individually and thus, do not have any "opposite side" counterparts.

The exercise apparatus 100 includes a frame 110 which extends from a forward end to a rearward end and has an I-shaped base configured to rest upon a floor surface. A forward stanchion extends upward from the base at the forward end of the frame 110, and a rearward stanchion extends upward from the base at the rearward end of the frame 110. Also, a trunnion extends upward from the base at an intermediate portion of the frame 110. The linkage assembly is movably interconnected between the rearward stanchion, the forward stanchion, and the intermediate trunnion. Generally speaking, the linkage assembly links rotation of left and right cranks 120 to generally elliptical motion of left and right foot supports 155. The term "generally elliptical motion" is intended in a broad sense to describe a closed path of motion having a relatively longer first axis and a relatively shorter second axis (which extends perpendicular to the first axis).

On each side of the apparatus 100, a respective crank 120 is rotatably mounted on the rear stanchion via a common crank shaft. The depicted crank 120 is a disc which also functions as a pulley (or sprocket), but the invention is not limited to this particular arrangement. A flywheel 124 is rotatably mounted on the rear stanchion, beneath the crank disc 120, and is connected in "stepped-up" fashion to the crank disc 120. In particular, a relatively smaller diameter pulley (or sprocket) is rigidly secured to the flywheel 124 and linked to the crank disc 120 by means of a looped linkage member 122, such as a timing belt (or chain). An eddy current resistance device 126 is mounted on the frame 110 and operatively connected to the flywheel 124. The components described in this paragraph, as well as their arrangement and operation, are well known in the art. Generally speaking, the flywheel 124 adds inertia to the linkage assembly, and the eddy current resistance device 126 provides adjustable resistance to rotation of the flywheel 124 (and associated movement of the components of the linkage assembly).

A radially displaced portion of each crank 120 is rotatably connected to an intermediate portion of a respective connector link 130 at a respective connection point 132. The lower end of each connector link 130 is rotatably connected to a rearward end of a respective rocker link 140 at a respective connection point 134. An opposite, forward end of each rocker link 140 is pivotally connected to the intermediate trunnion at a respective connection point 141. An opposite, upper end of each connector link 130 is rotatably connected to a rearward end of a respective foot supporting link 150 at a respective connection point 135. An opposite, forward end of each foot supporting link 150 is rotatably connected to a lower end of a respective rocker link 160 at a respective connection point 156. An intermediate portion of each foot supporting link 150 is sized and configured to function as a respective foot support 155. An opposite, upper end of each rocker link 160 is rotatably connected to the forward stanchion at pivot axis P (shown in FIG. 2).

On each side of the apparatus 100, a hub 166 is rigidly secured to the upper end of a respective rocker link 160 and has a star-shaped or keyed perimeter which projects axially, in a direction away from the central plane of symmetry. A generally annular member 186 has a central, star-shaped opening or keyway which fits snugly about a respective hub 166, thereby keying the two members 186 and 166 to one another. For reasons that become more apparent below, the member 186 is resilient and preferably made of rubber. The resilient member 186 has a star-shaped or keyed perimeter which is similar in shape but larger in size than the perimeter of the hub 166. A plate 176 has a central, star-shaped opening or keyway which fits snugly about a respective resilient member 186, thereby keying the two members 186 and 176 to one another. A handlebar 170 has a lower end which is rigidly connected to a respective plate 176, and an opposite, upper end 177 which is sized and configured for grasping in a respective hand of a user standing on the foot supports 155.

On each side of the apparatus 100, two pegs 168 are rigidly secured to a respective hub 166, project axially outward from the hub 166, and define a gap therebetween. A metal strip 178 has an upper end which is disposed in the gap between a respective pair of pegs 168, and an opposite, lower end which is rigidly secured to a respective plate 176 by suitable means (such as screws and/or welding). A separate strain gauge 188 (or other suitable sensor) is mounted lengthwise on each strip 178, and is connected to a respective wire 189 which extends into the frame 110 via a centrally located bore in a centrally located bar 116. Covers 180, sized and configured to span the exposed side of the plates 176 (and the components within the perimeter of the plates 176), are preferably secured (by bolts, for example) to respective hubs 166 to shroud the components and/or prevent relative axial movement between respective plates 176, annular members 186, and hubs 166.

The strain gauge 188 operates in a manner known in the art to generate an electrical signal which is indicative of strain experienced by the strip 178. An alternative type of suitable sensor may simply measure displacement, for example. Those skilled in the art will also recognize that similar sensor arrangements (and/or flexing arrangements) may be placed on other suitable portions of the apparatus 100 to measure work and/or provide tactile feedback in response to the application of arm force.

Generally speaking, the arrangement inside each cover 180 biases a respective handlebar 170 to remain in a particular orientation relative to a respective rocker link 160. As a result, each handlebar 170 will simply pivot together with a respective rocker link 160 (entirely "in sync") when a user of the apparatus 100 is exercising his lower body to the exclusion of his upper body. However, when the user applies force through either handlebar 170, the respective resilient member 186 will accommodate some pivoting or "flexing" of the handlebar 170 relative to the respective rocker link 160. The freedom to move the handlebar 170 out of sync, although limited in range, tends to provide the user with the sensation of having accomplished something with his upper body independent of the motion associated with exercise of his lower body. In other words, the user can increase the arm exercise stroke relative to the leg exercise stroke, simply by pulling and/or pushing on respective handles 177, preferably in a manner which remains coordinated with movement of the rocker links 160. Generally speaking, the length of the arm exercise stroke is a function of force exerted by the user against the handles 177 (under a given set of operating parameters). On the preferred embodiment 100, the dampening effect of the rubber members 186 tends to limit the rate of change in the length of the arm exercise stroke. Also, if desired, the available range of relative motion may be strictly limited by placing overlapping stops on the handlebars 170 and either the rocker links 160 or the frame 110.

Figure 4A:
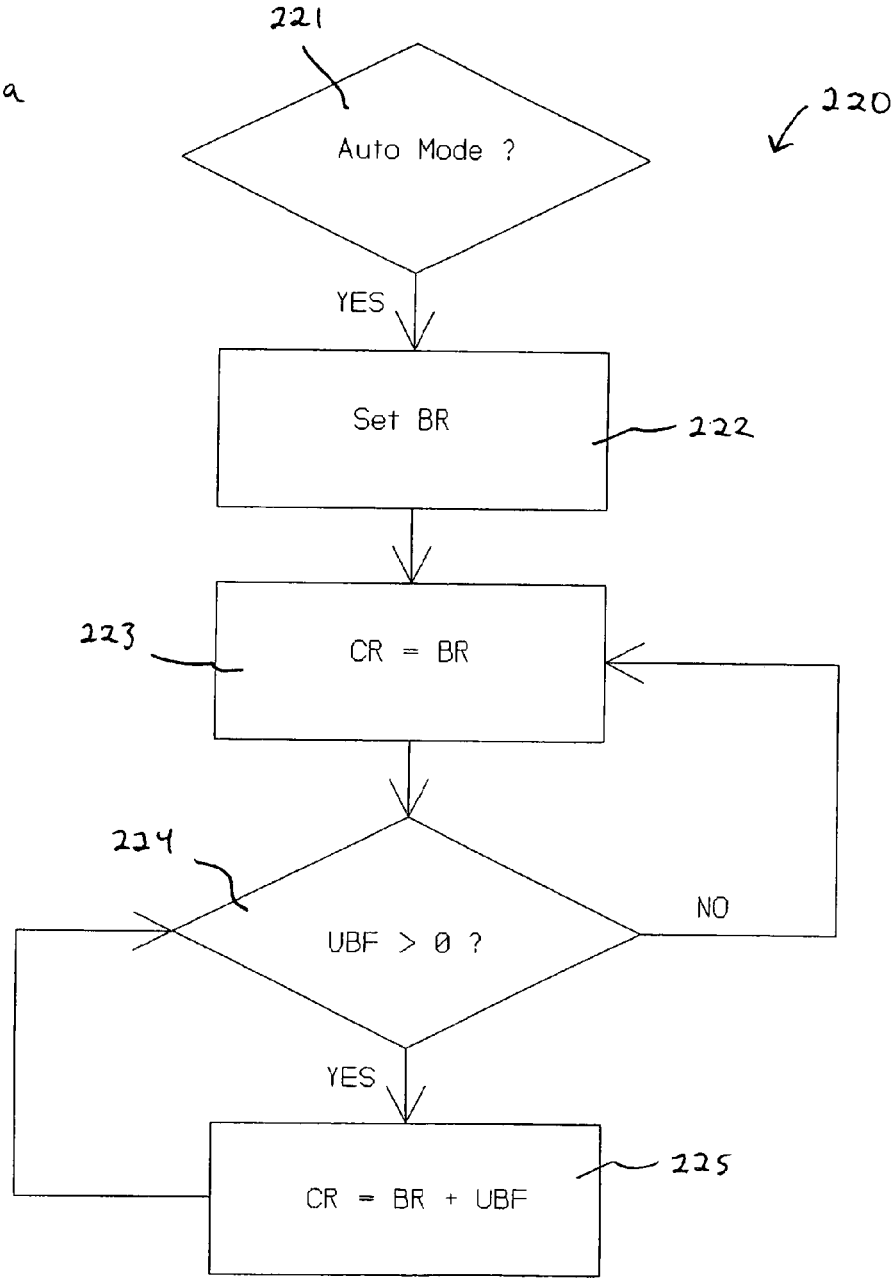
FIG. 4*a* is a flow chart of a control program suitable for use in conjunction with the exercise apparatus of FIG. 1.

Movement of a handlebar 170 relative to a respective rocker link 160 places strain on a respective strip 178. The magnitude of the strain (and/or the displacement experienced by the strip 178) may be used to assess the amount of work performed via the user's upper body and/or the relative amounts of work performed via the user's upper body and the user's lower body. This information may be displayed in various forms to the user and/or used in connection with various functions of the apparatus 100. For example, FIG. 4*a* shows a flow chart of a program 220 suitable for controlling the resistance device 126 during variable operation of the handlebars 170. The program 220 is described as "Auto Mode" because it is designed to automatically adjust the resistance device 126 as a function of force applied against the handlebars 170.

As an initial step 221, the program 220 activates in response to a signal to enter the Auto Mode. The next step 222 is to set the base resistance (BR) for resisting exercise of the lower body only. For example, the base resistance may be set manually by the user, or as part of a pre-programmed exercise routine, or based upon steady state operation of the apparatus 100 over the course of a particular time period. The next step 223 is to set the current resistance (CR) for the resistance device 126 to equal the base resistance (BR). The next step 224 is to process incoming data, if any, from the sensors 188. If no upper body force (UBF) is detected, then the program 220 returns to the step 223 of setting the current resistance (CR) equal to the base resistance (BR). On the other hand, if upper body force (UBF) is detected, then the next step 225 is to increase the current resistance (CR) to provide a reactionary force to the upper body force (UBF). The program 220 then repeats the data processing step 224, which may involve taking multiple samples and/or performing mathematical analysis on the incoming data.

Figure 4B:
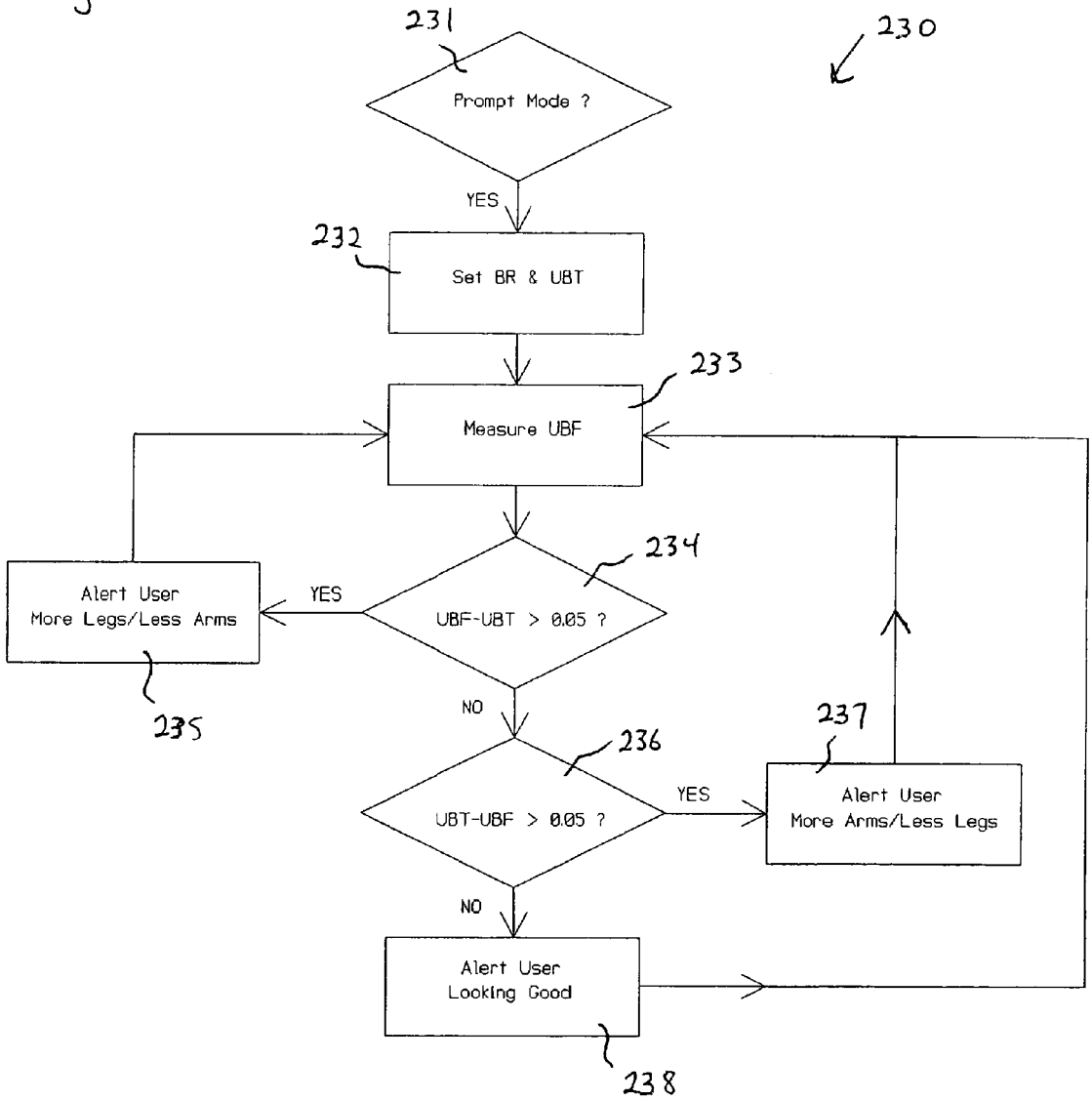
FIG. 4*b* is a flow chart of another control program suitable for use in conjunction with the exercise apparatus of FIG. 1.

FIG. 4*b* shows a flow chart of a program 230 suitable for signalling the user during variable operation of the handlebars 170. The program 230 is described as "Prompt Mode" because it prompts the user to distribute work between the upper body and lower body in accordance with a predetermined target distribution.

As an initial step 231, the program 230 activates in response to a signal to enter the Prompt Mode. The next step 232 is to set the base resistance (BR) and the upper body target (UBT) as a percentage of the base resistance. For example, the base resistance may be set manually by the user, or as part of a pre-programmed exercise routine, or based upon a heart rate portion of the control program, and the upper body target may be set manually by the user and/or established by another portion of the control program. The next steps 233-238 involve the gathering and processing of data from the sensors 188. If step 234 determines that upper body force (UBF) exceeds the upper body target (UBT) by more than 5%, then the next step 235 signals the user to use more legs and/or less arms, and then the sampling step 233 is repeated. Otherwise, step 236 determines whether or not the detected upper body target (UBT) exceeds the upper body force (UBF) by more than 5%. If yes, then step 237 signals the user to use more arms and/or less legs, and then the sampling step 233 is repeated. If no, then step 238 signals the user that the actual distribution of work is comparable to the target distribution of work, and then the sampling step 233 is repeated. The program may be further refined to distinguish between the user's left and right arms and/or the user's left and right legs, and/or to compare total actual exertion to a total target level of exertion.

Figure 3:
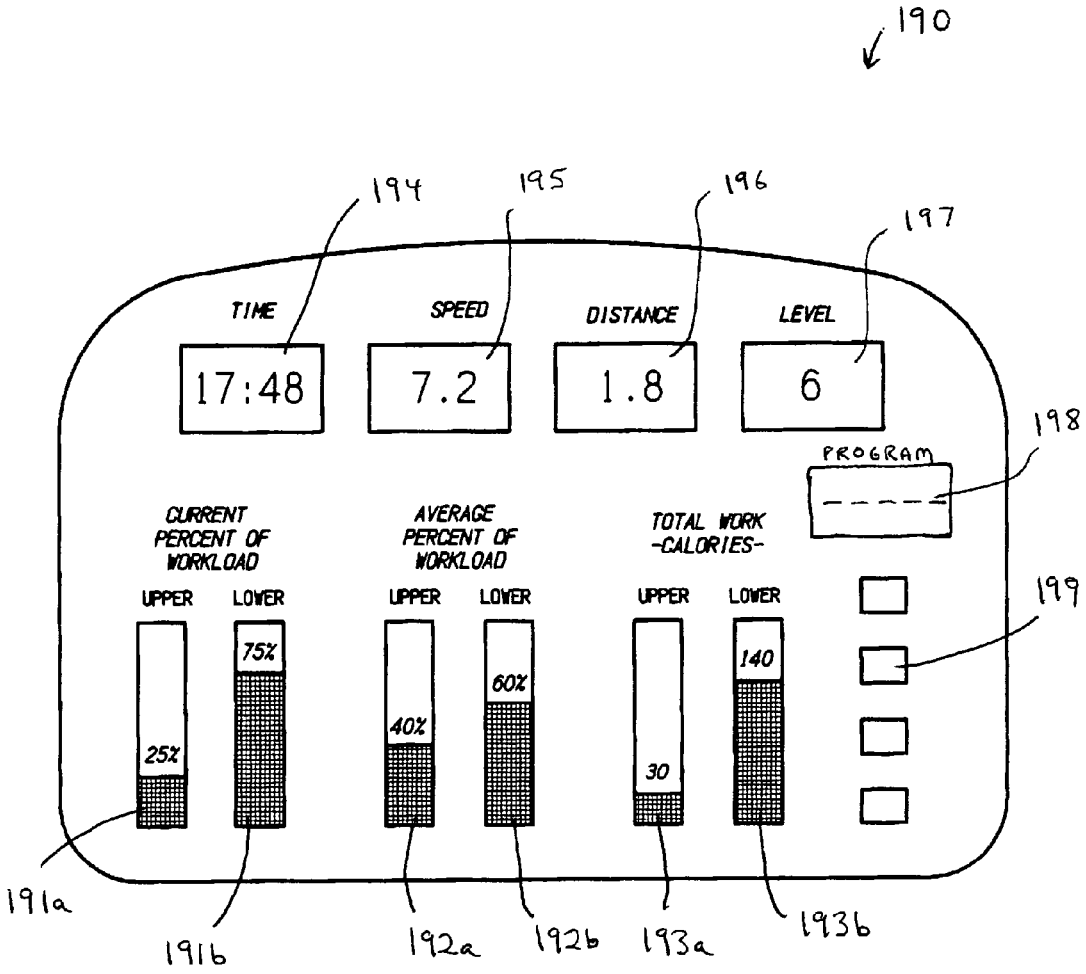
FIG. 3 is a plan view of a user interface on the exercise apparatus of FIG. 1.

A user interface 190 is mounted on top of the forward stanchion on the machine 100. Various programs, including the programs 220 and 230, are stored within the memory of the interface 190, and both the strain gauges 188 and the eddy current resistance device 126 are placed in communication with a controller in the user interface 190 (via wires or other suitable means). As suggested in FIG. 3, the user interface 190 may be configured to perform a variety of functions, including displaying information to the user, such as (a) available exercise parameters and/or programs, (b) the current parameters and/or currently selected program (see windows 197 and 198), (c) the current time, (d) the elapsed exercise time (see window 194), (e) the current and/or average speed of exercise (see window 195), (f) the amount of work performed during exercise, (g) the simulated distance traveled during the current workout session and/or over the course of multiple workout sessions (see window 196), (h) material transmitted over the internet, and/or (i) discrete amounts of work being performed by the user's arms and/or legs.

With respect to information based upon multiple workout sessions, the interface 190 may be programmed to store cumulative data and also, to distinguish between multiple users of the apparatus 100. With regard to the distribution of work, bar graphs 191*a* and 191*b* show the relative amounts of work currently being performed by a user's upper body and lower body, respectively; bar graphs 192*a* and 192*b* show the relative amounts of work performed over the course of a workout by a user's upper body and lower body, respectively; and bar graphs 193*a* and 193*b* show the relative amounts of work performed over the course of multiple workouts by a user's upper body and lower body, respectively.

The user interface 190 may also be configured to perform functions allowing the user to (a) select or change the information being viewed, (b) select or change an exercise program, (c) adjust the resistance to exercise of the arms and/or the legs, (d) adjust the stroke length of the arms and/or the legs (if available), (e) adjust the orientation of the exercise motion (if available), and/or (f) quickly stop the exercise motion of the arms and/or the legs (if available). To facilitate the selection of such options, the user interface 190 includes user operable input devices 199 which may be used at various times and/or in various combinations to achieve a desired result. The devices 199 may be push buttons or sensors integrated into a display, and they may be labeled according to their functions.

Those skilled in the art will recognize that various functions of the apparatus 100 may be controlled by and/or performed in response to various types of signals, including (a) the user activating an input device 199 on the user interface 190 or on either handle 177; (b) a sensor detecting the presence or absence of the user's hands on the handles 177; (c) a sensor detecting the user's level of exertion (user exerted force and/or heart rate, for example) for comparison to a target level or range; (d) an automated program; and/or (e) a person other than the user (such as a trainer) who is in communication with the apparatus (via remote control and/or the internet, for example).

Those skilled in the art will also recognize that other types of input devices and/or displays may be used without departing from the scope of the present invention. For example, FIG. 5 shows an alternative user interface 200 with two alternative displays of the relative amounts of work performed by a user's upper body and lower body. A first, digital display 202 shows the percentage of work performed by the user's upper body adjacent to the percentage of work performed by the user's lower body. A second, analog display includes a scale 204 and an indicator 206 which moves along the scale 204 to indicate the percentage of work being performed by whichever portion of the user's body is currently performing the majority of the work. The user interface 200 also includes three LED displays 207-209 which may be alternatively lit to indicate the relationship between the user's current distribution of work and the user's target distribution of work. More specifically, the illumination of display 207 signals the user to increase the effort on upper body exercise; the illumination of display 208 signals the user to maintain the current distribution of work between upper body and lower body; and the illumination of display 209 signals the user to increase the effort on lower body exercise. Those skilled in the art will recognize that audible signals may used together with or in place of visible signals.

Another alternative user interface 210 is shown in FIG. 6. Two analog displays are aligned relative to one another to facilitate a visual comparison between the target distribution of work and the actual distribution of work. Each display includes an identical scale 214 and a respective indicator 216 or 218. The "target" indicator 216 moves along the upper scale 214 to indicate the user's target distribution of work between upper body and lower body, and the "actual" indicator 218 moves along the lower scale 214 to indicate the user's actual distribution of work between upper body and lower body. If desired, all of the foregoing displays may be enhanced to distinguish between the left and right sides of the person's body, as well.

Figure 7:
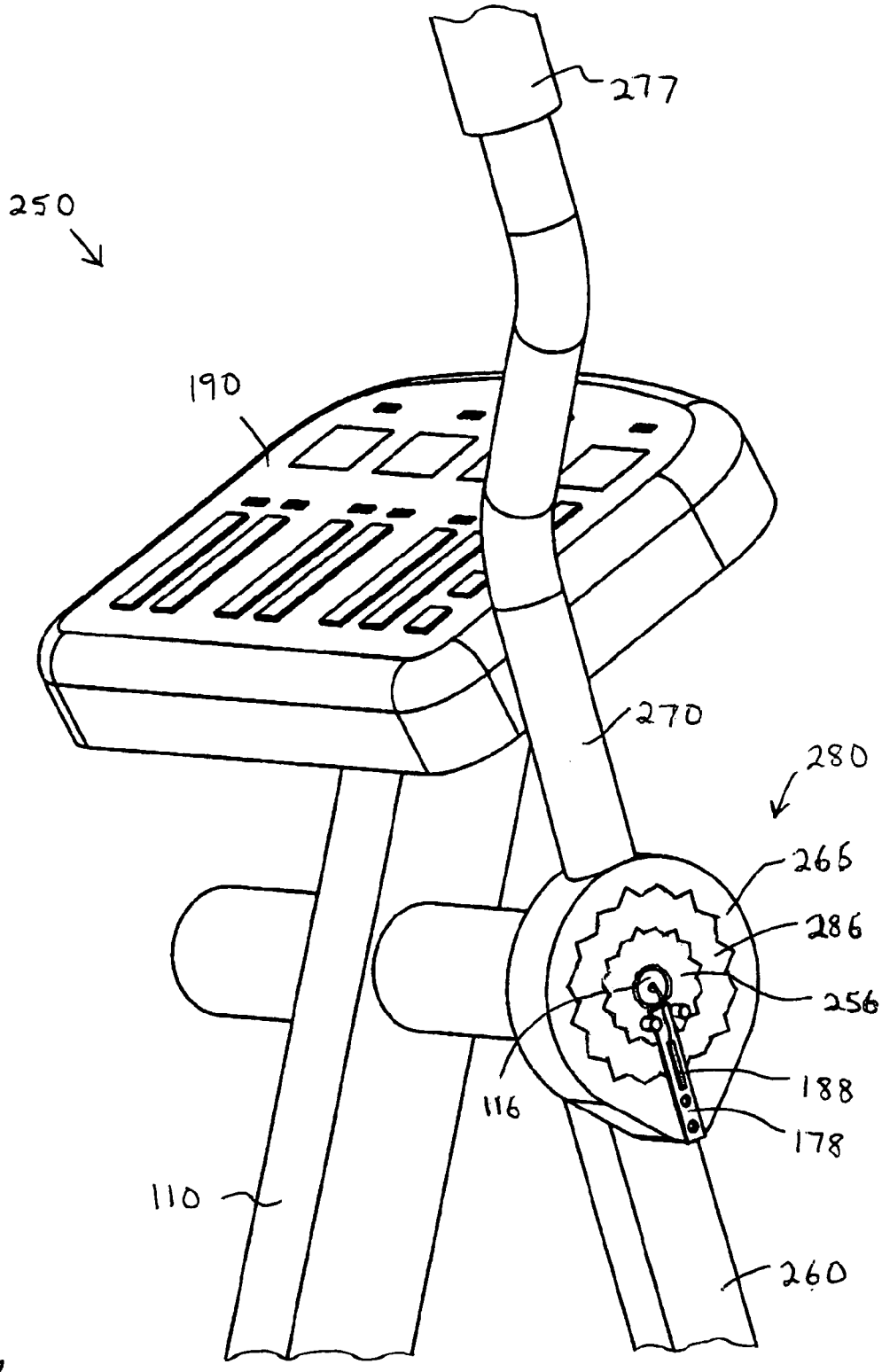
FIG. 7 is a perspective view of another exercise apparatus constructed according to the principles of the present invention.

The present invention may be implemented in various ways and/or to achieve various results. For example, another embodiment of the present invention is shown in FIG. 7. As suggested by the common reference numerals, the apparatus 250 is similar to the first embodiment 100, except for the rocker link 260, the handlebar 270, and the manner in which they are connected to one another and the frame 110 at connection assembly 280. In particular, a steel hub 256 is rotatably mounted on frame member 116, and a resilient member 286 is mounted on and about the hub 256 and keyed thereto, and a steel plate 266 is mounted on and about the resilient member 186 and keyed thereto. In other words, the resilient member 286 is interconnected between the hub 256 and the plate 266. Both the rocker link 260 and the handlebar 270 are rigidly secured to the plate 266. In response to the application of user force against the handle 277, the resilient member 286 is compressed between the plate 266 and the hub 256, causing the strip 178 to experience strain as a function of such force.

Another, related embodiment may be implemented by switching each connection assembly 280 with a respective pivot joint 156 defined between the rocker link 260 and the foot supporting link 150. Yet another approach is to form the handlebars and respective rocker links as unitary pieces and place suitable sensors on the handle portions 277 of the handlebars or between the handlebars and movable handgrips on the handlebars. Sensors may be connected to the foot supports 155, as well or in the alternative.

Figure 8:
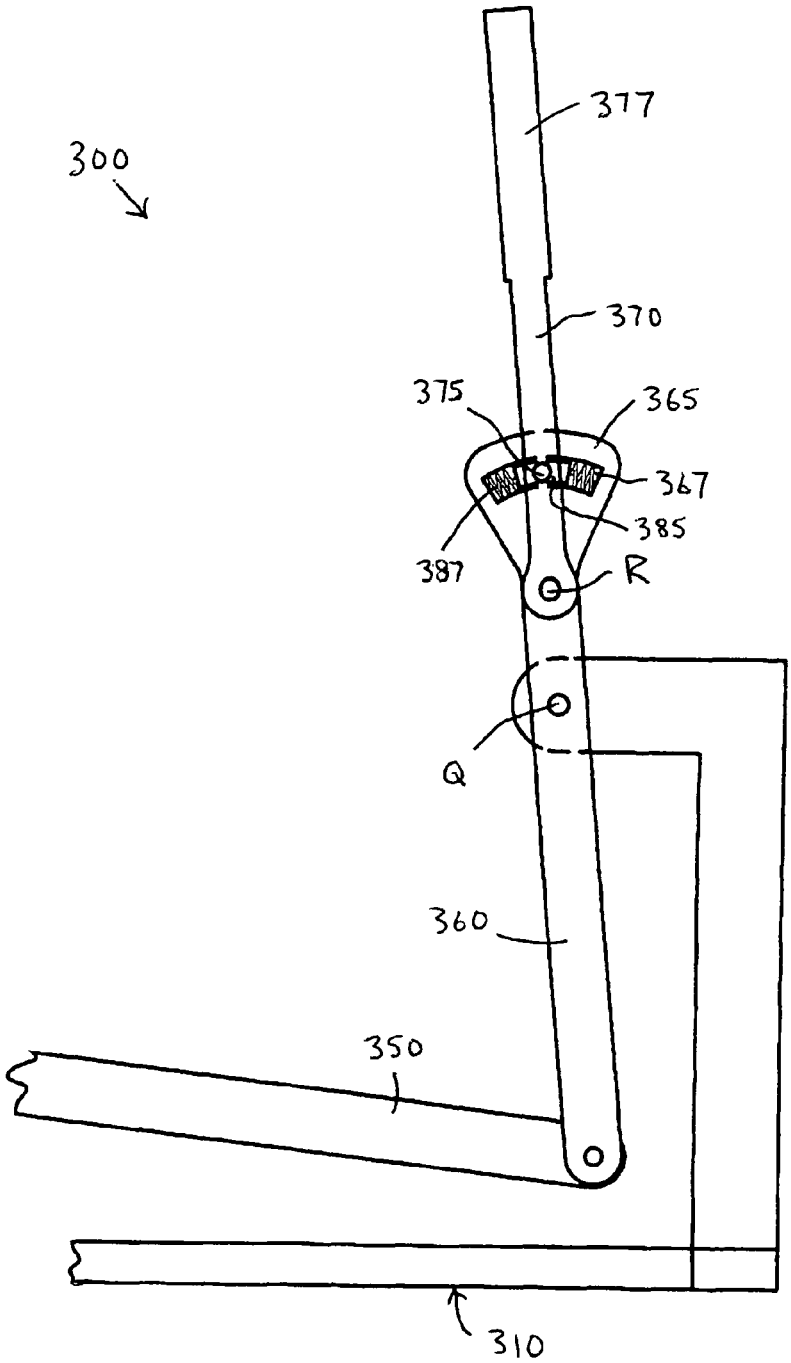
FIG. 8 is a side view of yet another exercise apparatus constructed according to the principles of the present invention.

Still another embodiment of the present invention is designated as 300 in FIG. 8. The exercise apparatus 300 includes a frame 310 designed to rest upon a floor surface, and a leg exercise assembly similar to that on the first embodiment 100. Among other things, the leg exercise assembly includes left and right foot supporting links 350 having forward ends rotatably connected to lower ends of respective rocker links 360. An intermediate portion of each foot supporting link is sized and configured to support a person's foot, and is constrained to move through a generally elliptical path.

An intermediate portion of each rocker link 360 is rotatably connected to the frame 310 at pivot axis Q. Left and right handlebars 370 have respective lower ends rotatably connected to respective rocker links 360 at respective pivot axes R (disposed a distance above the pivot axis Q). An opposite, upper end 377 of each handlebar 370 is sized and configured for grasping by a person standing on the foot supporting links 350.

An upper end 365 of each rocker link 360 is configured to provide an arcuate slot 367 which is centered about a respective pivot axis R. A respective block 385 is movably mounted within each slot 367, and is rigidly secured to an intermediate portion of a respective handlebar 370 (by means of a bolt 375, for example). First and second resilient members 387 are preferably disposed in respective gaps defined between opposite sides of the block 385 and opposite ends of the slot 367 to bias the handlebar 370 toward an aligned orientation relative to the rocker link 360. On this embodiment 300, the resilient members 387 are helical coil springs, but rubber blocks may be used in the alternative.

In the absence of user force applied against the handles 377, the handlebars 370 pivot in synchronized fashion together with respective rocker links 360. However, the resilient members 387 allow the handlebars 370 to be forcibly moved relative to respective rocker links 360 at the discretion (and strength) of the user. The embodiment 300 is shown without strain gauges or other sensors to emphasize that (1) the "flexible synchronization" feature; (2) the "responsive resistance" feature; and (3) the "display of work distribution" feature may implemented independent of each other, as well as in various combinations. Additional examples of variability include replacing the resilient member 286 on the embodiment 250 with a similarly sized and shaped rigid member, and/or replacing the strip 178 on the embodiment 100 with a sufficiently strong bar rigidly secured to both the plate 176 and the hub 166.

Figure 9:
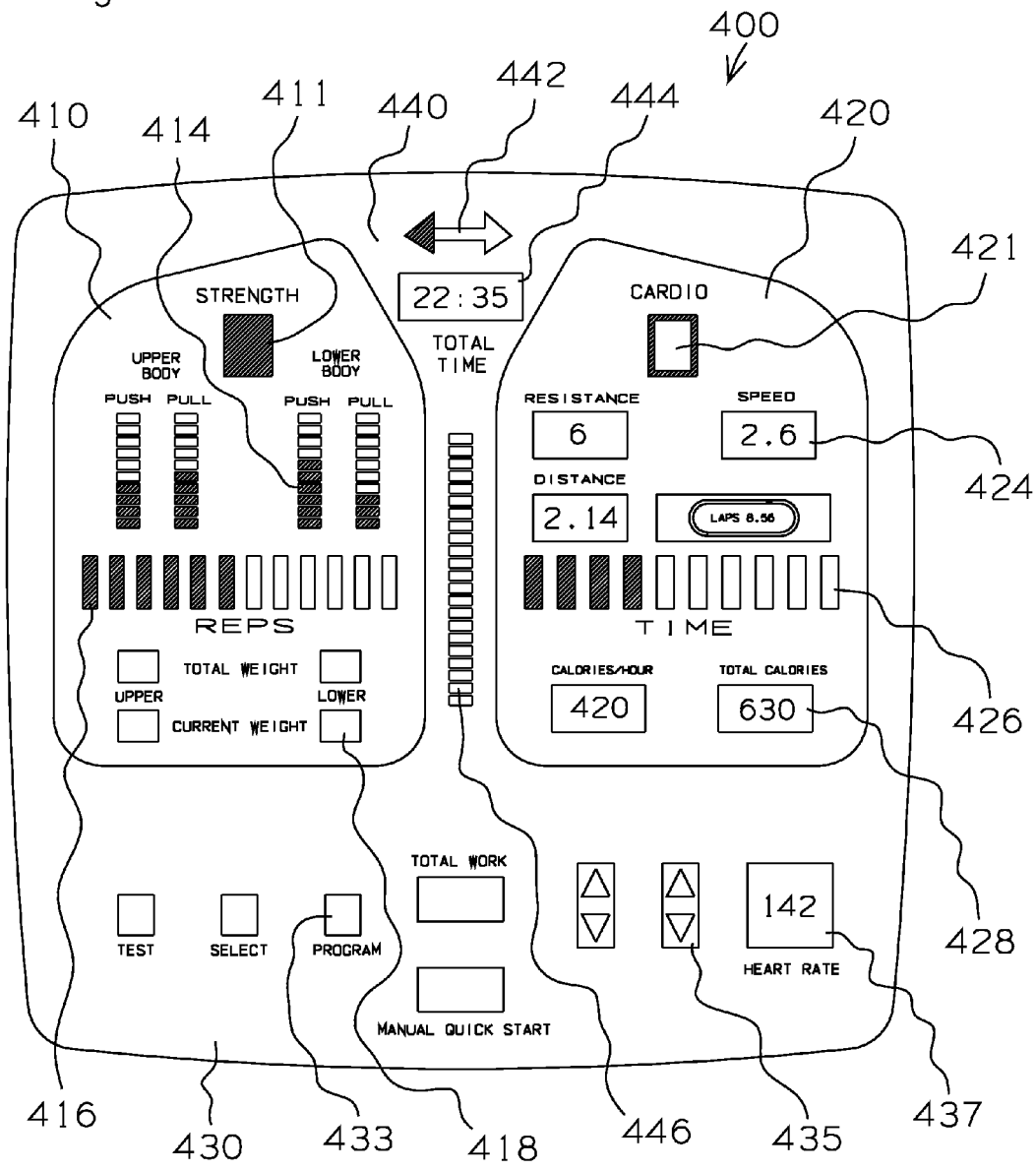
FIG. 9 is a plan view of a fourth user interface suitable for use on the exercise apparatus of FIG. 1 (or any other appropriate exercise apparatus)

FIG. 9 shows another user interface 400 suitable for use on various embodiments of the present invention, including the machine shown in FIG. 1. Like the other interfaces described herein, the interface 400 includes a display face that may be either a permanent arrangement or an image shown on a screen. A controller is placed in communication with both the display face and the strain gauges 188. The controller operates in a manner similar to the controller described above with reference to the display 190, but with a unique arrangement for data input and output. Among other things, the user interface 400 has a left side portion 410 that shows information primarily associated with strength exercise, a right side portion 420 that shows information primarily associated with cardio exercise, a bottom portion 430 that shows certain control information, and a central portion 440 that shows some general information associated with overall exercise.

The left side portion 410 includes a "Strength" label and signal box 411 that is preferably set up to illuminate when strength exercise is being performed by the user and/or encouraged by the controller. Beneath the Strength "header" are various data displays associated with the user's performance of strength-type exercise. For example, bar graphs 414 show the current amount of relative work being performed by the user's upper body and lower body in terms of pushing and pulling motion.

Below the bar graphs 414 is an array of boxes 416 that is lit sequentially from left to right as repetitions are performed during a strength phase of an exercise routine. When the row of boxes 416 is completely lit, it serves as a signal that the user has completed a satisfactory number of repetitions during that particular strength phase. At the successful conclusion of a strength phase, one of the boxes 446 in the central portion 440 of the display is lit. During each subsequent strength phase, the process is repeated. Below the "REPS" boxes 416 are data "read-outs" 418 that show the user's current strength effort and total strength effort in terms of upper body performance and lower body performance.

The right side portion 420 includes a "Cardio" label and signal box 421 that is preferably set up to illuminate when cardio exercise is being performed by a user and/or encouraged by the controller. Beneath the Cardio "header" are various data displays associated with the user's performance of cardio-type exercise. For example, data "read-outs" 424 show the user's speed and the machine's current resistance setting.

Below the read-outs 424 is an array of boxes 426 that is lit sequentially from left to right as "distance" is traversed during a cardio phase of an exercise routine. When the row of boxes 426 is completely lit, it serves as a signal that the user has successfully completed that particular cardio phase, and one of the boxes 446 in the central portion 440 of the display is lit. During each subsequent cardio phase, the process is repeated. Below the "TIME" boxes 426 are additional data "read-outs" 428 that show the user's effort in terms of calories burned.

The lower portion 430 includes a control panel having various user input devices 433 and 435 that guide operation of the controller and/or the machine as suggested by their labels. The lower portion 630 also includes a display 437 of the user's heart rate, which requires a heart rate monitor that is either connected to the user or integrated into the handles 177 (all in a manner already known in the art).

The central portion 440 of the interface 400 includes the column of boxes 446 that preferably light from bottom to top to tally completed phases of a workout. Above the boxes 446 is a "TOTAL TIME" read-out 444 to indicate how long the user has been exercising, and a two-headed arrow 442 that lights on the left end to indicate when strength exercise is being performed by the user and/or encouraged by the controller, and that lights on the right end to indicate when cardio exercise is being performed by the user and/or encouraged by the controller. The arrow 442 and the signal boxes 411 and 421 perform a similar task, and thus, may be used together or in lieu of one another.

For added visual effect, the Cardio information and/or the right side 420 of the interface 400 may be highlighted and/or lit in a first color, such as red, and the Strength information and/or the left side 410 of the interface 400 may be highlighted and/or lit in a second color, such as blue. In addition, the information that is not "mode specific" may be highlighted and/or lit in a third color, such as green. During exercise activity, the screen may switch between cardio mode, wherein the Cardio box 421 is illuminated to the exclusion of the Strength box 411, and strength mode, wherein the Strength box 411 is illuminated to the exclusion of the Cardio box 421. The switching between modes may be prompted by a control program, input from the user, or a controller signal based upon the user's performance. Generally speaking, the controller will increase resistance to exercise in the strength mode, and decrease resistance to exercise in the cardio mode.

Figure 10:
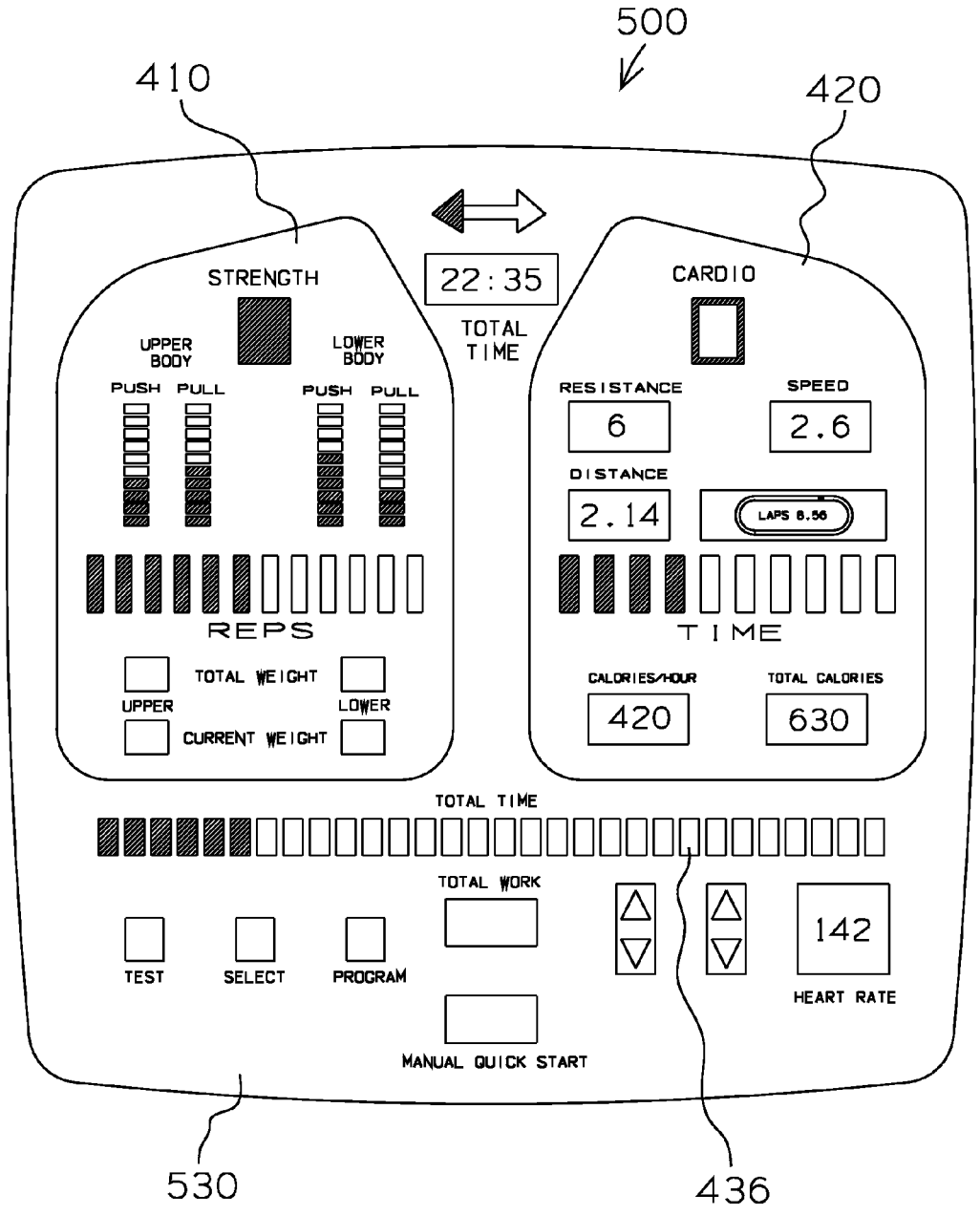
FIG. 10 is a plan view of a fifth user interface suitable for use on the exercise apparatus of FIG. 1 (or any other appropriate exercise apparatus)

FIG. 10 shows a user interface 500 that is similar in many respects to the previously described interface 400. In fact, the only difference is that completed phases of exercise are tallied in a row of boxes 436 disposed in the lower portion 530 of the interface 500 (just below the left and right portions 410 and 420).

Figure 11:
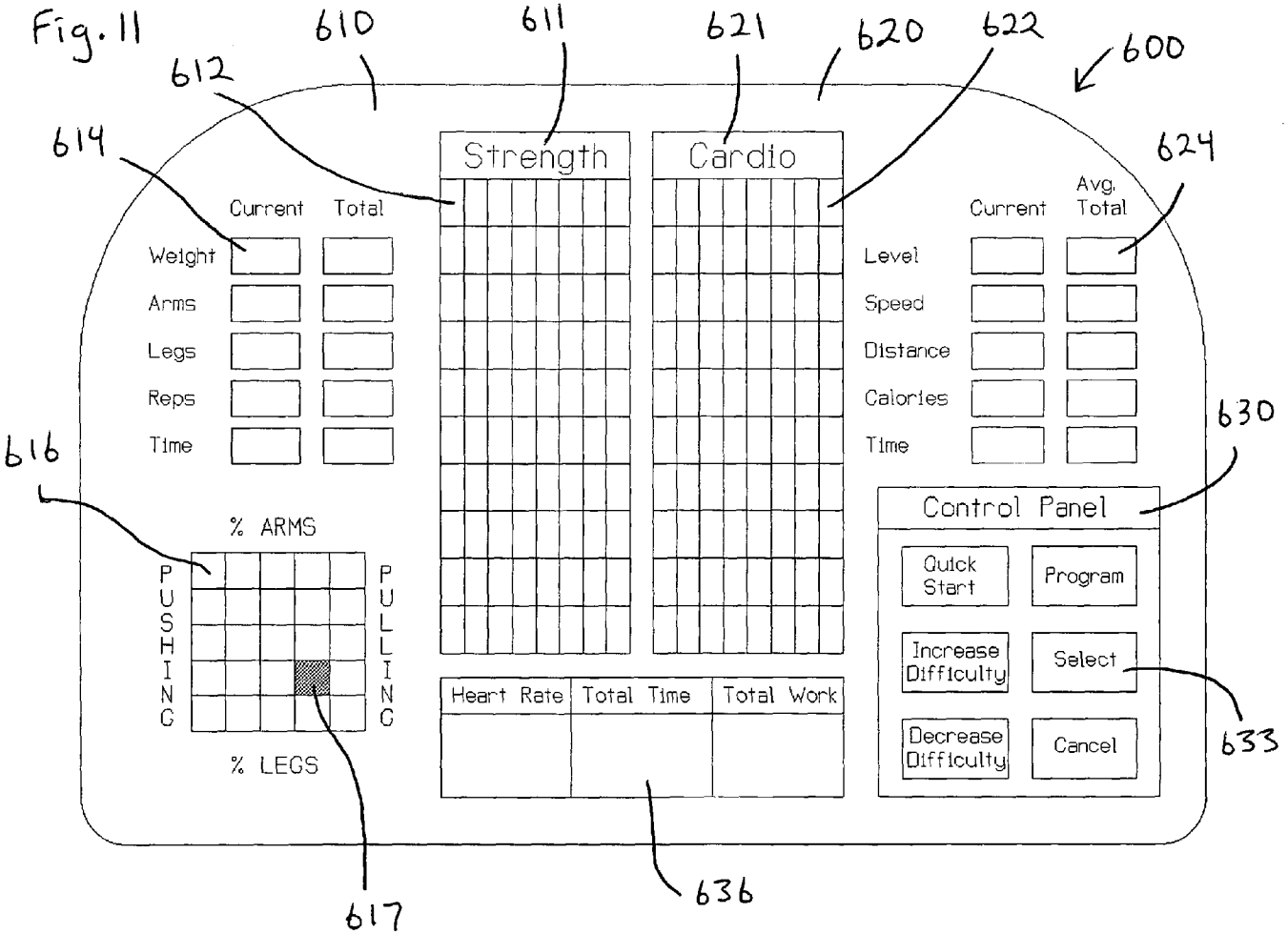
FIG. 11 is a plan view of a sixth user interface suitable for use on the exercise apparatus of FIG. 1 (or any other appropriate exercise apparatus)

FIG. 11 shows another user interface 600 suitable for use on various embodiments of the present invention, including the machine shown in FIG. 1. Like the other interfaces described herein, the interface 600 includes a display face that may be provided as either a permanent arrangement or an image on a screen. A controller is placed in communication with both the display face and the strain gauges 188 or comparable sensors on another machine. The controller operates in a manner similar to the controller described above with reference to the display 190, but with a unique arrangement for data input and output. The user interface 600 has a left side portion 610 that shows information primarily associated with strength exercise, and a right side portion 620 that shows both information primarily associated with cardio exercise and certain control information.

The left side portion 610 includes a "Strength" header box 611 that is preferably set up to illuminate when strength exercise is being performed (or encouraged). Beneath the Strength header box 611 is an array of smaller, "progress" boxes 612. A column of boxes 612 is lit sequentially from bottom to top as repetitions are performed during a strength phase of an exercise routine. When a column of boxes 612 is completely lit, it serves as a signal that the user has completed a satisfactory number of repetitions during that particular strength phase. During the next strength phase, an adjacent column of boxes 612 is lit in similar fashion. When all of the columns of boxes 612 are lit, they serve as a signal that the user has satisfactorily completed all strength phases of the exercise routine.

The left side portion 610 also includes an array of "read-out" boxes 614 associated with certain labeled performance measurements. These boxes 614 show specific data based on the user's current and total strength performance, as indicated by the adjacent labels. The left side portion 610 also includes an array of "relativity" boxes 616 that illustrate the relative amount of arm and leg force exerted separately in pushing and pulling fashion. A "cursor" 617 is continuously updated relative to the boxes 616 during strength exercise to show the current source of force being exerted.

The right side portion 620 includes a "Cardio" header box 621 that is preferably set up to illuminate when cardio exercise is being performed (or encouraged). Beneath the Cardio header box 621 is an array of smaller, "progress" boxes 622 similar to the Strength progress boxes 612. A column of boxes 622 is lit sequentially from bottom to top as exercise is performed during a cardio phase of an exercise routine. When a column of boxes 622 is completely lit, it serves as a signal that the user has satisfactorily completed a cardio phase. During the next cardio phase, an adjacent column of boxes 622 is lit in similar fashion. When all of the columns of boxes 622 are lit, they serve as a signal that the user has satisfactorily completed all cardio phases of the exercise routine.

The right side portion 620 also includes an array of "read-out" boxes 624 associated with certain labeled performance measurements. These boxes 624 show specific data based on the user's current and total strength performance, as indicated by the adjacent labels. The right side portion 620 also includes a control panel 630 having a header panel 630 and various user input devices 633 that guide operation of the controller as suggested by their labels. The header panel 630 shows various information in response to user input and/or exercise activity, in order to assist a user in changing exercise parameters or programs, for example.

Beneath the arrays of boxes 612 and 622, some additional "read-out" boxes 636 are provided to display data regarding a user's overall exercise performance. The heart rate requires a heart rate monitor that is either connected to the user or integrated into the handles 177 (all in a manner already known in the art).

For added visual effect, the Cardio information and/or the right side 620 of the interface 600 may be highlighted and/or lit in a first color, such as red, and the Strength information and/or the left side 610 of the interface 600 may be highlighted and/or lit in a second color, such as blue. In addition, the information that is not "mode specific" may be highlighted and/or lit in a third color, such as green. During exercise activity, the screen may switch between cardio mode, wherein the Cardio header 621 is illuminated to the exclusion of the Strength header 611, and strength mode, wherein the Strength header 611 is illuminated to the exclusion of the Cardio header 621. The switching between modes may be prompted by a control program, input from the user, or a controller signal based upon the user's performance. Generally speaking, the controller will increase resistance to exercise in the strength mode, and decrease resistance to exercise in the cardio mode.

Figure 12:
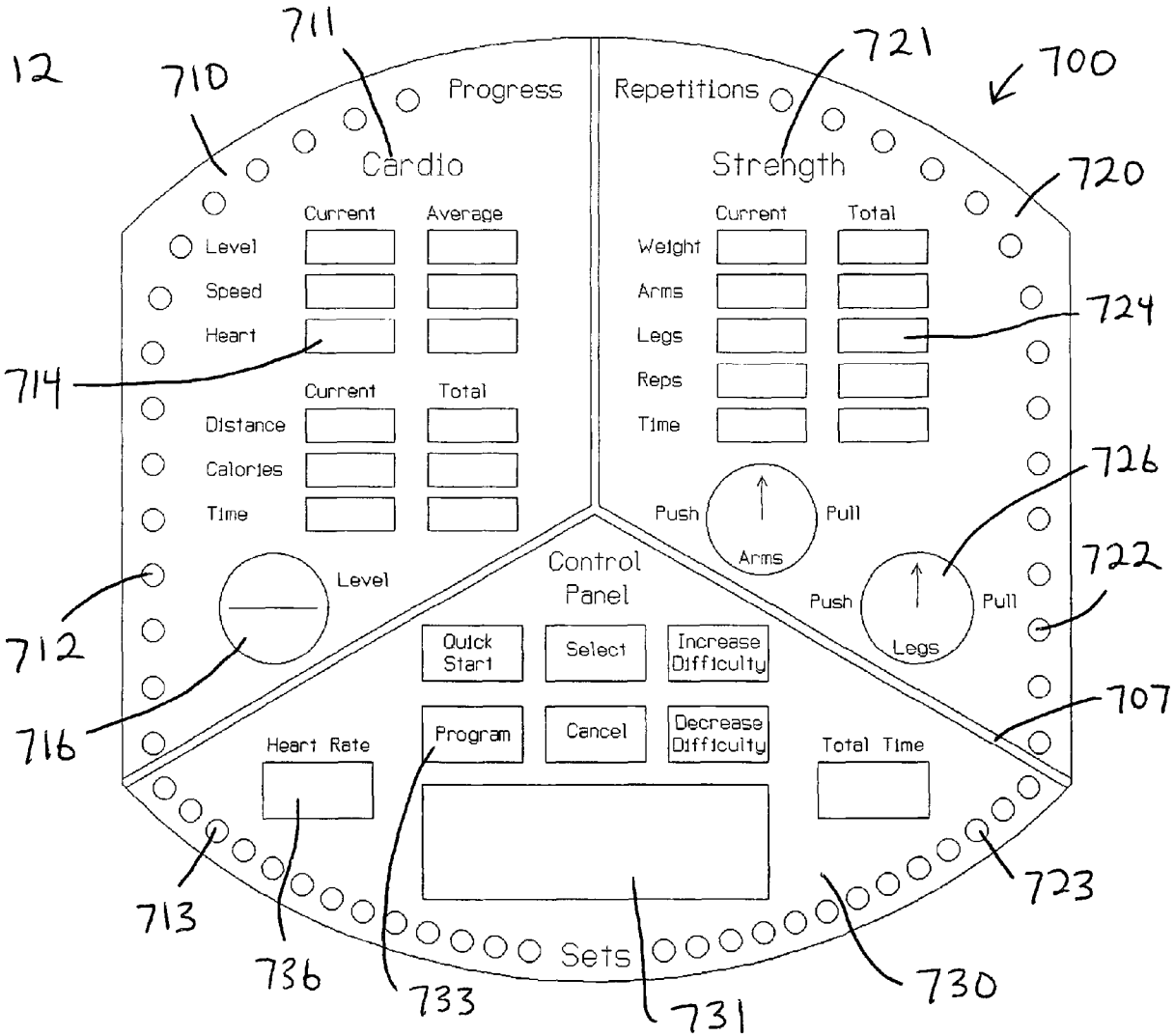
FIG. 12 is a plan view of a seventh user interface suitable for use on the exercise apparatus of FIG. 1 (or any other appropriate exercise apparatus)

FIG. 12 shows another user interface 700 suitable for use on various embodiments of the present invention, including the machine shown in FIG. 1. Like the other interfaces described herein, the interface 700 includes a display face that may be either a permanent arrangement or an image on a screen. A controller is placed in communication with both the display face and the strain gauges 188 or comparable sensors on another machine. The controller operates in a manner similar to the controller described above with reference to the display 190, but with a unique arrangement for data input and output. The user interface 700 has an upper left section 710 that shows information primarily associated with cardio exercise, an upper right section 720 that shows information primarily associated with strength exercise, and a lower middle section 730 that shows certain control information and general exercise information.

The upper left section 710 includes a "Cardio" heading or label 711 that helps a user locate the cardio portion of the interface 700. Along the outside perimeter of the cardio section 710 is a string of "progress" dots 712. These dots 712 light sequentially from top to bottom as progress is being made during a cardio phase of an exercise routine. When the string of dots 712 is completely lit (or a single "cursor" light has progressed all the way to the bottom), it serves as a signal that the user has satisfactorily completed a cardio phase, and an appropriate one of the "Sets" dots 713 is lit in the control section 730 of the display. During the next cardio phase, the same string of dots 712 is lit in similar fashion, followed by another Sets dot 713. When all of the Sets dots 713 are lit on the left side of the control section 730, they serve as a signal that the user has satisfactorily completed all cardio phases of the exercise routine.

Beneath the cardio label 711, the upper left section 710 also includes an array of "read-out" boxes 714 associated with certain performance measurements. These boxes 714 show specific data based on the user's current and total cardio performance, as indicated by the adjacent labels. Also, graphs and/or meters may be provided to provide graphic illustrations of cardio exercise performance. For example, one such meter 716 is provided in the upper left section 710 to illustrate the level or inclination of the user's foot path.

The upper right section 720 includes a "Strength" heading or label 721 that helps a user locate the strength portion of the interface 700. Along the outside perimeter of the strength section 720 is a string of "progress" dots 722. These dots 722 light sequentially from top to bottom as repetitions are performed during a strength phase of an exercise routine. When the string of dots 722 is completely lit (or a single "cursor" light has progressed all the way to the bottom), it serves as a signal that the user has satisfactorily completed a strength phase, and an appropriate one of the "Sets" dots 723 is lit in the control section 730 of the display. During the next strength phase, the same string of dots 722 is lit in similar fashion, followed by another Sets dot 723. When all of the Sets dots 723 are lit on the right side of the control section 730, they serve as a signal that the user has satisfactorily completed all strength phases of the exercise routine.

Under circumstances where the number of depicted dots (of any type) differs from the scheduled or preferred exercise routine, the controller can compensate in various ways. For example, if a user is going to perform only 10 repetitions during a strength phase, then the program can light (or traverse) three dots after every two repetitions, or light the first six dots after performance of the first repetition. On the other hand, if a user is going to perform 20 repetitions during a strength phase, then the program can light (or traverse) three dots after every four repetitions, or strobe the first dot during each of the first five repetitions before beginning to sequentially light (or traverse) the dots. A similar approach may be taken with regard to distance during cardio phases, and/or sets accumulated in the control section.

The upper right section 720 also includes an array of "read-out" boxes 724 associated with certain performance measurements. These boxes 724 show specific data based on the user's current and total strength performance, as indicated by the adjacent labels. Also, graphs and/or meters may be provided to provide graphic illustrations of strength exercise performance. For example, respective meters 726 are provided in the upper right section 720 to illustrate the relatively amounts of pushing and pulling performed by a person's arms and legs.

The control section 730 includes a header or label that helps a user locate the control portion of the interface 700. A display area 731 is provided in the control section 730 to display various messages to the user in response to user input and/or exercise activity, in order to assist a user in changing exercise parameters or programs, for example. Also, various user input devices 733 are provided in the control section 730 to facilitate operation of the controller as suggested by their labels. Furthermore, in addition to the Sets dots 713 and 723, some additional "read-out" boxes 736 are provided to display data regarding a user's overall exercise performance. The heart rate display requires a heart rate monitor that is either connected to the user or integrated into the handles 177 (all in a manner already known in the art).

For added visual effect, the various sections of the interface 700 may be highlighted and/or lit in discrete colors, and/or the perimeter (including associated borders 707) of the "active" section may illuminate to draw the user's attention. Also, the Sets dots 713 and 723 may be illuminated in the respective colors of their related sections to help maintain a connection therebetween. During exercise activity, the screen may switch between cardio mode, strength mode, and control mode, as prompted by a control program, input from the user, or a controller signal based upon the user's performance. Generally speaking, the controller will increase resistance to exercise in the strength mode, and decrease resistance to exercise in the cardio mode.

Figure 13:
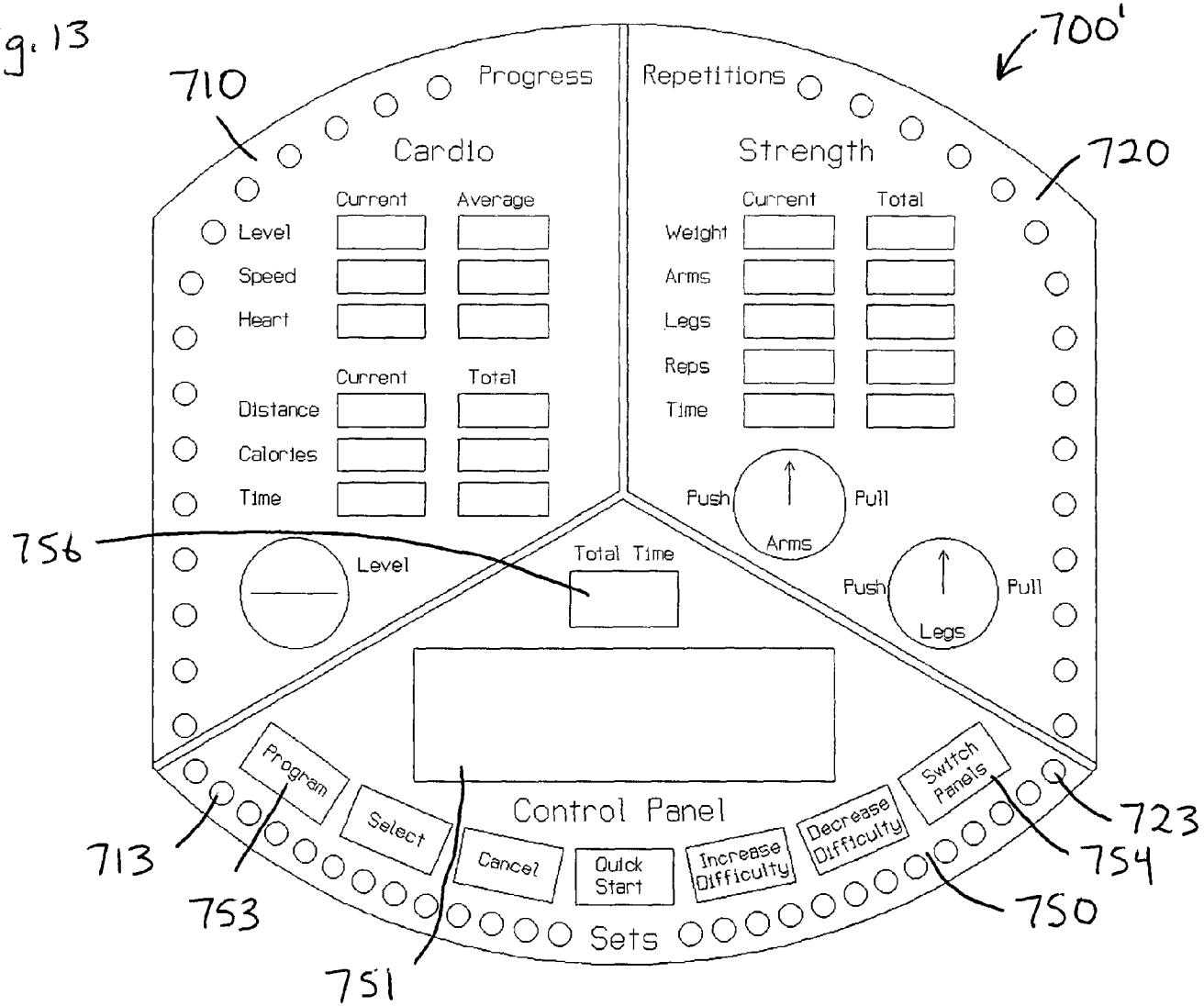
FIG. 13 is a plan view of a eighth user interface suitable for use on the exercise apparatus of FIG. 1 (or any other appropriate exercise apparatus)

FIG. 13 shows another user interface 700' suitable for use on various embodiments of the present invention, including the machine shown in FIG. 1. As suggested by the common reference numerals, the interface 700' is similar in many respects to the interface 700. In fact, the only difference is the arrangement of the control panel portion 750 of the interface 700. The user input devices 753 are arranged in an arc along the bottom of the control section 750. These devices 753 include a Switch Panels input device 754 that allows the user to promptly switch among the three sections 710, 720, and 750. For example, if the cardio section 710 is active, and the user operates the Switch Panels input device 754, then the control section 750 becomes active, and if the user operates the Switch Panels input. device 754 again, then the strength section 720 becomes active. The Control Panel label is centrally located just above the input devices 753, and just below the display area 751. The Total Time "read-out" 756 is centrally located at the top of the section 750.

Figure 14:
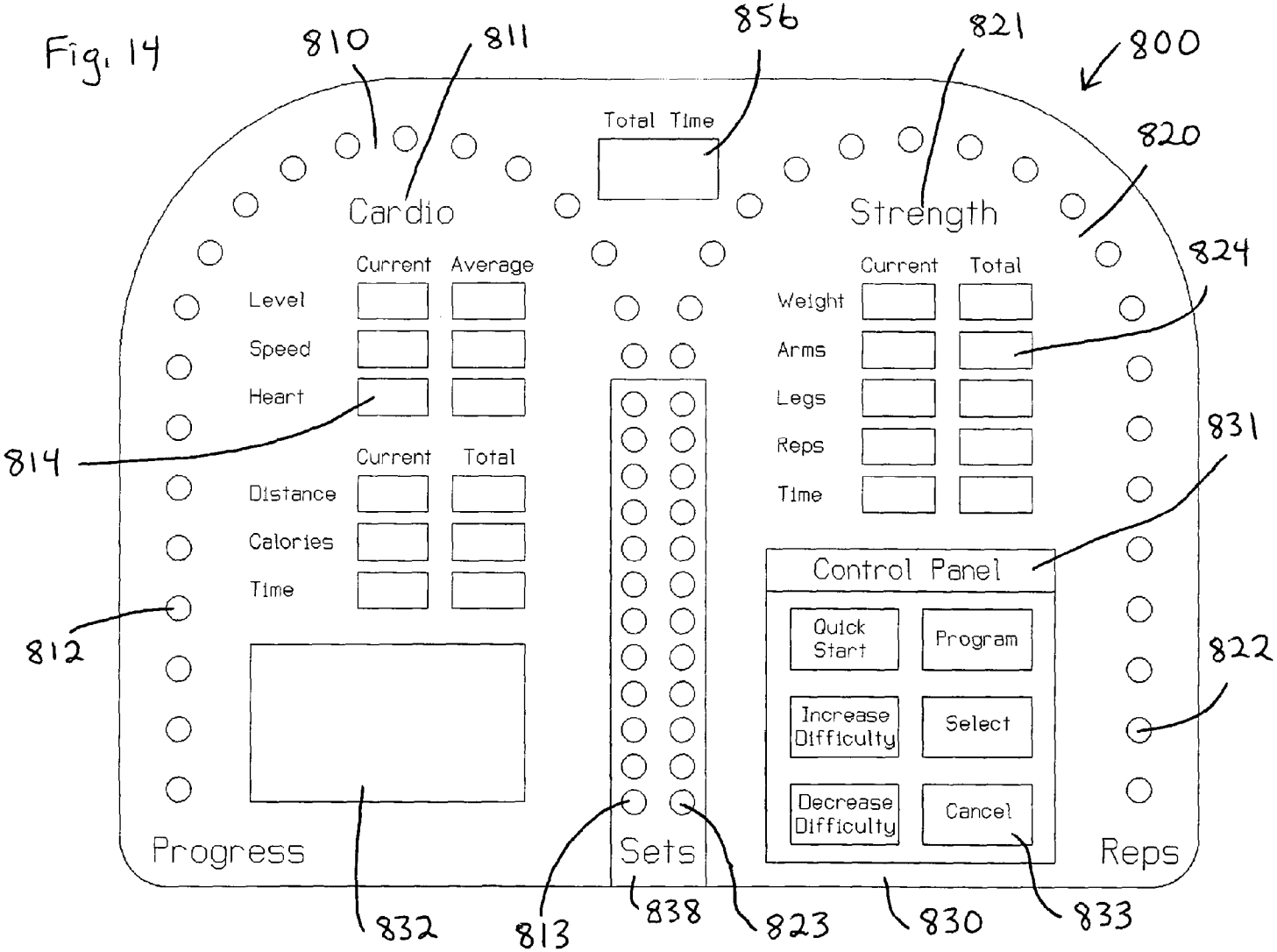
FIG. 14 is a plan view of a ninth user interface suitable for use on the exercise apparatus of FIG. 1 (or any other appropriate exercise apparatus)

FIG. 14 shows another user interface 800 suitable for use on various embodiments of the present invention, including the machine shown in FIG. 1. Like the other interfaces described herein, the interface 800 includes a display face that may be either a permanent arrangement or an image on a screen. A controller is placed in communication with both the display face and the strain gauges 188 or comparable sensors on another machine. The controller operates in a manner similar to the controller described above with reference to the display 190, but with a unique arrangement for data input and output. The user interface 800 has a generally upper left section 810 that shows information primarily associated with cardio exercise, a generally upper right section 820 that shows information primarily associated with strength exercise, and a lower middle section 830 that shows certain control information and overall exercise information.

The upper left section 810 includes a "Cardio" heading or label 811 that helps a user locate the cardio portion of the interface 800. Along the outside perimeter of the cardio section 810 is a string of "progress" dots 812. These dots 812 light sequentially from bottom to top as progress is being made during a cardio phase of an exercise routine. When the string of dots 812 is completely lit (or a single "cursor" light has progressed all the way around to the center of the display 800), it serves as a signal that the user has satisfactorily completed a cardio phase, and an appropriate one of the "Sets" dots 813 is lit in the "Sets" box 838. During the next cardio phase, the same string of dots 812 is lit in similar fashion, followed by another Sets dot 813. When all of the Sets dots 813 are lit on the left side of the Sets box 838, they serve as a signal that the user has satisfactorily completed all cardio phases of the exercise routine.

Beneath the cardio label 811, the upper left section 810 also includes an array of "read-out" boxes 814 associated with certain performance measurements. These boxes 814 show specific data based on the user's current and total cardio performance, as indicated by the adjacent labels. Although not shown on this embodiment, graphs and/or meters may be included to provide graphic illustrations of cardio exercise performance, as well.

The upper right section 820 includes a "Strength" heading or label 821 that helps a user locate the strength portion of the interface 800. Along the outside perimeter of the strength section 820 is a string of "progress" dots 822. These dots 822 light sequentially from bottom to top as repetitions are performed during a strength phase of an exercise routine. When the string of dots 822 is completely lit (or a single "cursor" light has progressed all the way around to the center of the display 800), it serves as a signal that the user has satisfactorily completed a strength phase, and an appropriate one of the "Sets" dots 823 is lit in the "Sets" box 838. During the next strength phase, the same string of dots 822 is lit in similar fashion, followed by another Sets dot 823. When all of the Sets dots 823 are lit on the right side of the Sets box 838, they signal that the user has satisfactorily completed all strength phases of the exercise routine.

As discussed above with reference to the preceding embodiment 700, when the number of depicted dots (of any type) differs from the scheduled or preferred exercise routine, the controller can compensate in various ways. For example, if a user is going to perform only 10 repetitions during a strength phase, then the program can light (or traverse) two dots after every repetition, or light the first eleven dots after performance of the first repetition. On the other hand, if a user is going to perform 30 repetitions during a strength phase, then the program can light (or traverse) two dots after every three repetitions, or strobe the first dot during each of the first ten repetitions before beginning to sequentially light (or traverse) the dots. A similar approach may be taken with regard to distance during cardio phases, and/or sets accumulated in the control section.

The upper right section 820 also includes an array of "read-out" boxes 824 associated with certain performance measurements. These boxes 824 show specific data based on the user's current and total strength performance, as indicated by the adjacent labels. Although not shown, graphs and/or meters may be included to provide graphic illustrations of strength exercise performance, as well.

The control section 830 is spread out beneath the other sections 810 and 820 and between the progress dots 812 and 822. The control section 830 includes the sets box 838, which is aligned with the proximate ends of the strings of dots 812 and 822 (to provide a visual connection between the dots associated with a single phase and the dots associated with completed phases). A display area 832 is provided in the control section 830 to display various messages to the user in response to user input and/or exercise activity, in order to assist a user in changing exercise parameters or programs, for example. The section 830 also includes header or label 831 that helps a user locate the control portion of the interface 800. Also, various user input devices 833 are provided in the control section 830 to facilitate operation of the controller as suggested by their labels. Furthermore, a "Total Time" box 856 is provided at an upper middle location.

For added visual effect, the various sections of the interface 800 may be highlighted and/or lit in discrete colors. Also, the Sets dots 813 and 823 may be illuminated in the respective colors of their related sections to help maintain a connection therebetween. During exercise activity, the screen may switch between cardio mode, strength mode, and control mode, as prompted by a control program, input from the user, or a controller signal based upon the user's performance. Generally speaking, the controller will increase resistance to exercise in the strength mode, and decrease resistance to exercise in the cardio mode.

Figure 15:
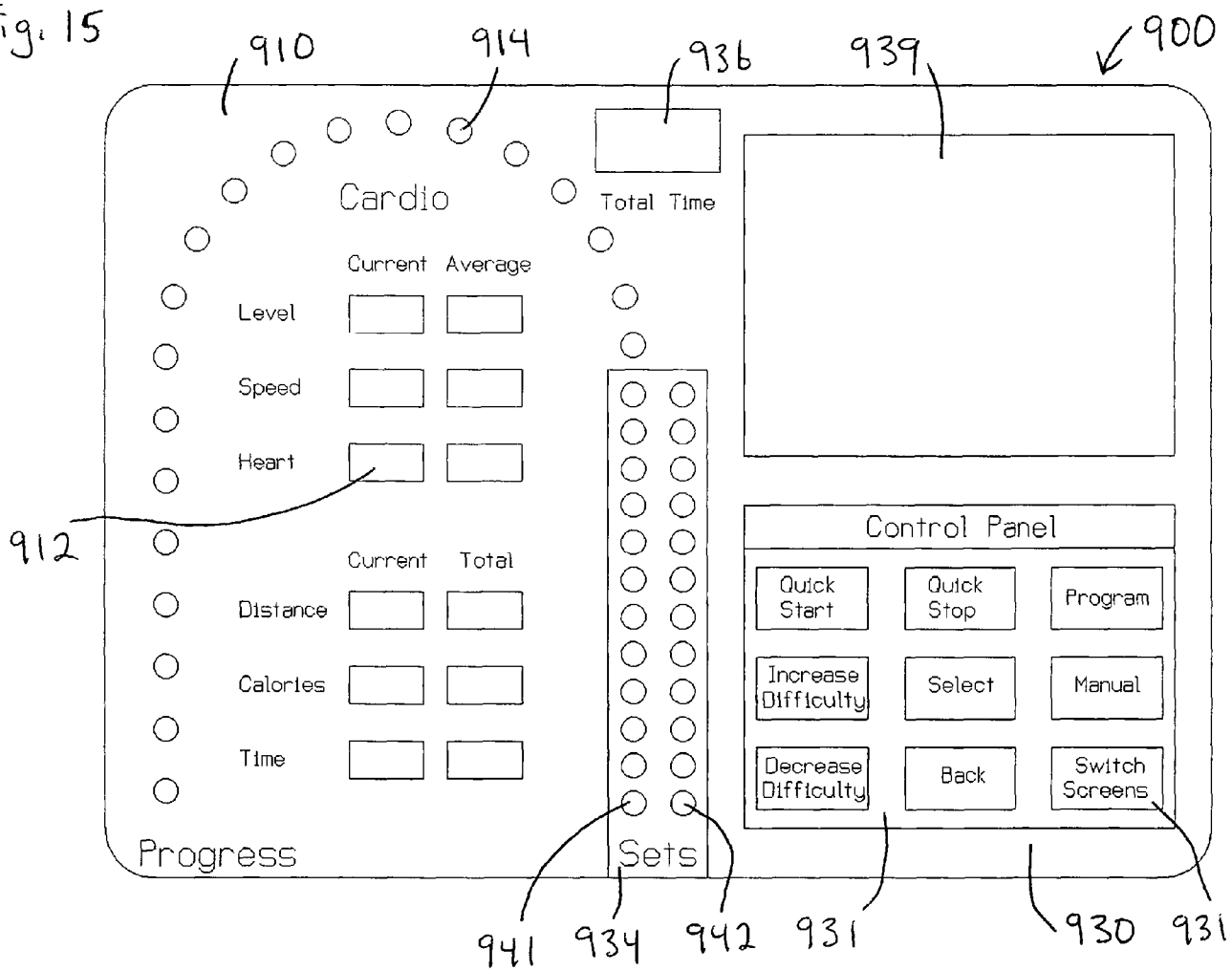
FIG. 15 is a plan view of a tenth user interface suitable for use on the exercise apparatus of FIG. 1 (or any other appropriate exercise apparatus)
Figure 16:
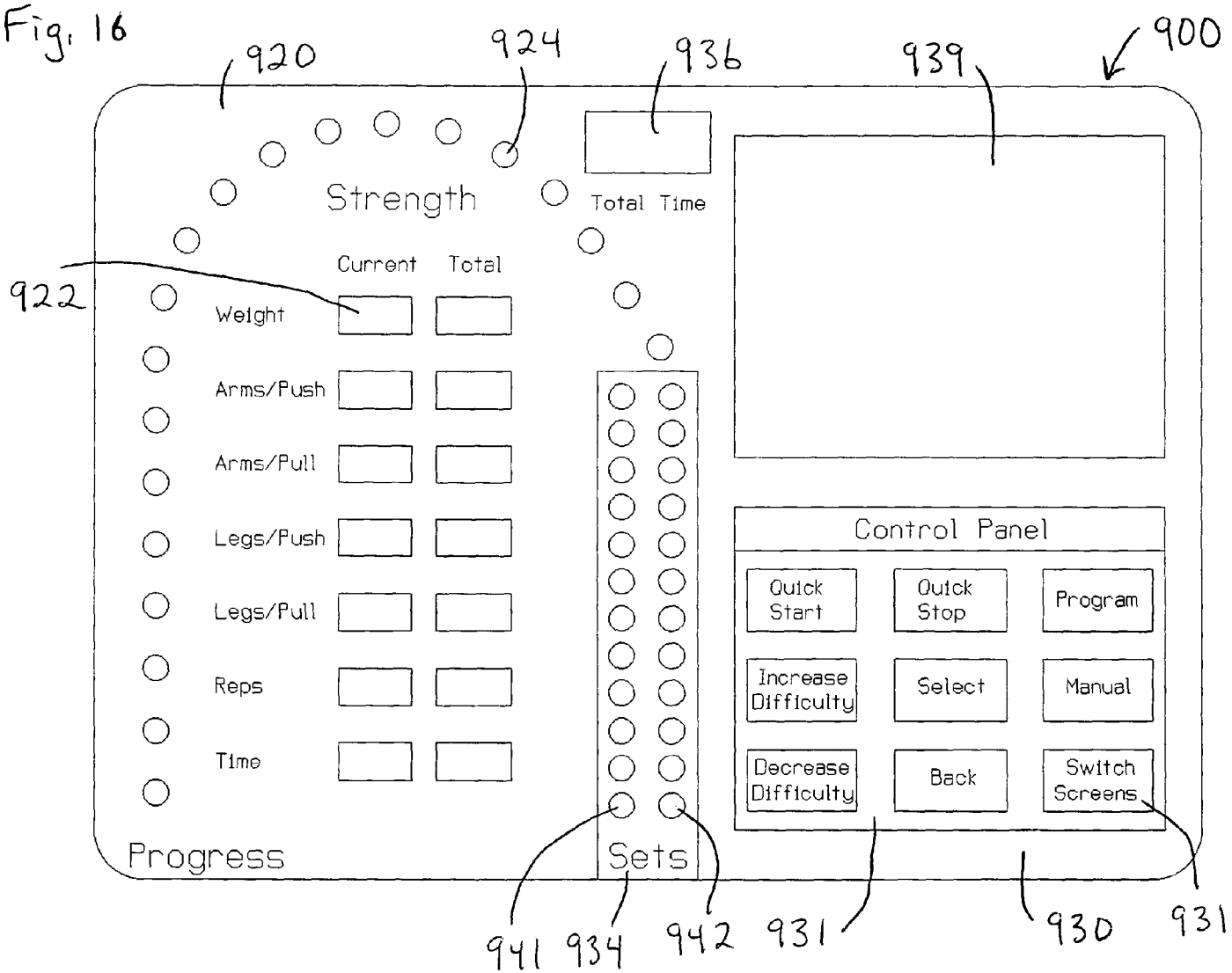
FIG. 16 is a plan view of the user interface of FIG. 15 with an alternative display shown on the interface screen.

FIGS. 15-16 show a user interface 900 having a right side portion 930 that remains the same, and a left side portion that changes between a "Cardio" display (designated as 910 in FIG. 15) and a "Strength" display (designated as 920 in FIG. 16). The right side portion 930 includes a control panel 931 having a heading area and various user input sensors 933 beneath the heading area. These sensors 933 include a "Switch Screens" sensor that allows a user to toggle between the Cardio display 910 and the Strength display 920. The right side portion 910 also includes a display area 939 that shows various information in response to user input and/or exercise activity.

The right side or common portion 930 further includes a centrally located "Sets" counter area 934, and a centrally located "Total Time" display 938. The Sets area 934 includes a first column of dots 941 that aligns with a string of dots 914 in the Cardio display 910, and a second column of dots 942 that aligns with a string of dots 924 in the Strength display 920.

When the interface 900 is in the cardio mode, the "Cardio" display 910 appears on the left portion of the interface 900 to show various information about the user's current cardio performance and total cardio performance. As suggested by the labels associated with the "read-outs" 912, some of the total performance data may be displayed in terms of an average, while other such data may be displayed in terms of a total. The "Cardio" display also includes a series of "Progress" indicators or dots 914 that extend up and around the display 900 and terminate at the top of the left hand column in the "Sets" counter area 934.

When the interface 900 is in the strength mode, the "Strength" display 920 appears on the left portion of the interface 900 to show various information about the user's current strength performance and total strength performance. The labels associated with the "read-outs" 922 suggest the type of information that may be displayed. The "Strength" display also includes a series "Progress" indicators or dots 924 that extend up and around the display 900 and terminate at the top of the right hand column in the "Sets" counter area 934.

The interface 900 is preferably programmed to switch the left side portion between the "Cardio" display 910 and the "Strength" display 920 whenever a switch is made between modes of exercise. The switch may be performed in response to a control signal from a program, and/or a user can manually switch between the "Cardio" display 910 and the "Strength" display 920 by touching or pressing the "Switch Screens" sensor 931 in the Control Panel. Also, the switch may occur in response to sensor input that indicates the user is performing work with his/her arms in excess of a threshold amount of work, and/or is performing more than a threshold percentage of total work with his/her arms.

The present invention may also be described in functional terms along the following lines. On an exercise apparatus comprising a frame designed to rest upon a floor surface; an arm supporting member; and a leg supporting member, wherein at least one of the supporting members is movably mounted on the frame, the present invention may be described in terms of (a) means for interconnecting the leg supporting member and the arm supporting member in such a manner that the path traversed by the user's hand is synchronized relative to the path traversed by the user's foot, until a threshold amount of user force is applied against the arm supporting member, in which case, the hand path may deviate from its otherwise synchronized path relative to the foot path; and/or (b) means for connecting the leg supporting member and the arm supporting member in such a manner that the path traversed by the user's hand is synchronized relative to the path traversed by the user's foot and movable against a resistance force which is measured and/or applied independent of the leg supporting member; and/or (c) means for displaying the distribution of work between a user's upper body and lower body.

The present invention also may be said to provide various methods which may be implemented in various ways and/or described with reference to various embodiments, including the foregoing embodiments. One such method is to provide arm and leg supporting members which are both synchronized and subject to independent resistance. Another such method is to provide arm and leg supporting members which are both encouraged to remain synchronized and selectively movable relative to one another. Yet another method is to move a person's hands and feet through respective paths which are synchronized relative to one another, while allowing deviation from the synchronized path in response to user applied force and/or providing separate resistance to movement along the respective paths. Yet another method is to measure and/or display work performed separately by a person's upper body and lower body.

The present invention may also be described with reference to the user interfaces shown in FIGS. 9-16. As previously noted, these interfaces may be substituted for the interface 190 on the elliptical exercise machine 100, and/or they may used on other suitable exercise apparatus. Whereas the interface 190 distinguished between upper and lower body exercise, the interfaces shown in FIGS. 9-16 distinguish between exercise performed during one or modes of aerobic or cardio exercise, and exercise performed during one or modes of anaerobic or strength exercise. The particular mode of exercise may be determined manually by a user or a user's activity, or automatically by a control program. Also, each mode of exercise may be characterized simply by a change in designation, or by a change in an exercise parameter, such as the level of resistance or the relative amount of arm exercise. For example, cardio exercise may be associated with resistance below a threshold value, and strength exercise may be associated with resistance above the threshold value.

The foregoing embodiments and associated methods are representative but not exhaustive examples of the subject invention. It is to be understood that the embodiments and/or their respective features may be mixed and matched in a variety of ways to arrive at other embodiments. For example, the control and/or display options described with reference to a particular embodiment are applicable to other embodiments, as well. Moreover, additional and/or alternative sensors may be located elsewhere on the equipment to measure force and/or compare upper body and lower body work. For example, sensors may be placed in or near the hand grips and/or in or near the foot supports. In conclusion, recognizing that this disclosure will lead those skilled in the art to recognize additional embodiments, modifications, and/or applications which fall within the scope of the present invention, the scope of the present invention is to be limited only to the extent of the claims which follow.

What is claimed is:

1. An apparatus for encouraging diverse exercise activity of a user, comprising:

a frame;

force receiving members linked to the frame for movement in closed paths relative to the fame, the force receiving members comprising an arm supporting member moved by an arm of the user and a leg supporting member moved by a leg of the user;

resisting means for resisting movement of the force receiving members in the closed paths; and a user interface for setting a level of resistance to movement of the force receiving members provided by the resisting means and for displaying a first arrangement of first exercise performance data and for displaying a separate second arrangement of second exercise performance data, wherein the first exercise performance data describes exercise performed by the user while the resisting means is providing a first level of resistance to movement of the force receiving members that is less than a threshold level, wherein the second exercise performance data describes exercise performed by the user while the resisting means is providing a second level of resistance to movement of the force receiving members that is greater than the threshold level, wherein the user interface switches the level of resistance to movement of the force receiving members provided by the resisting means between the first and second levels of resistance during the exercise activity, wherein the threshold level of resistance is such that the user is encouraged to perform primarily cardio exercise when the resisting means provides less than the threshold level of resistance, and such that the user is encouraged to perform primarily strength exercise when the resisting means provides greater than the threshold level of resistance, and wherein the user interface indicates that the user is performing primarily cardio exercise when the resisting means is providing less than the threshold level of resistance to movement of the force receiving members and displays an indication that the user is performing primarily strength exercise when the resisting means is providing greater than the threshold level of resistance to movement of the force receiving members.

2. The apparatus of claim 1 wherein the user interface switches the level of resistance to movement of the force receiving members provided by the force resisting means between the first and second levels in response to user input.

3. The apparatus of claim 1 wherein the user interface switches the resistance to movement of the force receiving members provided by the force resisting means from the first level to the second level when the user has performed a first predetermined amount of exercise activity with the resistance set at the first level, and wherein the user interface switches the resistance to movement of the force receiving members provided by the force resisting means from the second level to the first level when the user has performed a second predetermined amount of exercise activity with the resistance set at the second level.

4. The apparatus in accordance with claim 1 wherein the user interface concurrently displays the first performance data and the second performance data.

5. The apparatus of claim 4 wherein the user interface adjusts appearances of the displayed first and second performance data to indicate whether the resisting means is providing the first or second level of resistance to movement of the force receiving members.

6. The apparatus of claim 1 wherein the user interface alternatively displays the first and second performance data by displaying the first performance data while the resisting means is providing less than the threshold level of resistance to movement of the force receiving members, and by displaying the second exercise performance data when the resisting means is providing greater than the threshold level of resistance to movement of the force receiving members.

7. The apparatus of claim 1 wherein the first exercise performance data indicates a cumulative amount of exercise performed by the user when the resisting means was providing less than the threshold level of resistance to movement of the force receiving members, and wherein the second exercise performance data indicates a cumulative amount of exercise performed by the user when the resisting means was providing greater than the threshold level of resistance to movement of the force receiving members.

8. An apparatus for encouraging diverse exercise activity of a user, comprising:

a frame;

force receiving members linked to the frame for movement in closed paths relative to the fame, the force receiving members comprising an arm supporting member moved by an arm of the user and a leg supporting member moved by a leg of the user;

resisting means for resisting movement of the force receiving members in the closed paths; and a user interface for setting a level of resistance to movement of the force receiving members provided by the resisting means and for displaying a first arrangement of first exercise performance data and for displaying a separate second arrangement of second exercise performance data, wherein the first exercise performance data describes exercise performed by the user while the resisting means is providing a first level of resistance to movement of the force receiving members that is less than a threshold level, wherein the second exercise performance data describes exercise performed by the user while the resisting means is providing a second level of resistance to movement of the force receiving members that is greater than the threshold level, wherein the user interface switches the level of resistance to movement of the force receiving members provided by the resisting means between the first and second levels of resistance during the exercise activity, wherein the threshold level of resistance is such that the user is encouraged to perform primarily cardio exercise when the resisting means provides less than the threshold level of resistance, and such that the user is encouraged to perform primarily strength exercise when the resisting means provides greater than the threshold level of resistance, wherein the user interface adjusts appearances of the displayed first and second performance data to indicate whether the resisting means is providing greater than or less than the threshold level of resistance to movement of the force receiving members, wherein the user interface indicates that the user is performing primarily cardio exercise when the resisting means is providing less than the threshold level of resistance to movement of the force receiving members and displays an indication that the user is performing primarily strength exercise when the resisting means is providing greater than the threshold level of resistance to movement of the force receiving members, wherein the first exercise performance data indicates a cumulative amount of exercise performed by the user when the resisting means was providing less than the threshold level of resistance to movement of the force receiving members, and wherein the second exercise performance data indicates a cumulative amount of exercise performed by the user when the resisting means was providing greater than the threshold level of resistance to movement of the force receiving members.

9. The apparatus of claim 8 wherein the user interface switches the level of resistance to movement of the force receiving members provided by the force resisting means between the first and second levels in response to user input.

10. The apparatus of claim 8 wherein the user interface switches the resistance to movement of the force receiving members provided by the force resisting means from the first level to the second level when the user has performed a first predetermined amount of exercise activity with the resistance set at the first level, and wherein the user interface switches the resistance to movement of the force receiving members provided by the force resisting means from the second level to the first level when the user has performed a second predetermined amount of exercise activity with the resistance set at the second level.

11. The apparatus in accordance with claim 8 wherein the user interface concurrently displays the first performance data and the second performance data.

12. The apparatus of claim 11 wherein the user interface adjusts appearances of the displayed first and second performance data to indicate whether the resisting means is providing the first or second level of resistance to movement of the force receiving members.

13. The apparatus of claim 8 wherein the user interface alternatively displays the first and second performance data by displaying the first performance data while the resisting means is providing less than the threshold level of resistance to movement of the force receiving members, and by displaying the second exercise performance data when the resisting means is providing greater than the threshold level of resistance to movement of the force receiving members.

* * * * *